US010808508B2

(12) United States Patent
Giroux et al.

(10) Patent No.: US 10,808,508 B2
(45) Date of Patent: Oct. 20, 2020

(54) TELEMETRY OPERATED TOOLS FOR CEMENTING A LINER STRING

(71) Applicant: Weatherford Technology Holdings, LLC, Houston, TX (US)

(72) Inventors: Richard Lee Giroux, Bellville, TX (US); Daniel Purkis, Cruden Bay (GB); Richard Dalzell, Kirriemuir (GB); Jason Duthie, Blackburn (GB); Ian Jaffrey, Insch (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 65 days.

(21) Appl. No.: 16/122,273

(22) Filed: Sep. 5, 2018

(65) Prior Publication Data

US 2019/0032456 A1 Jan. 31, 2019

Related U.S. Application Data

(62) Division of application No. 14/250,162, filed on Apr. 10, 2014, now Pat. No. 10,087,725.

(Continued)

(51) Int. Cl.
*E21B 43/10* (2006.01)
*E21B 33/13* (2006.01)

(Continued)

(52) U.S. Cl.
CPC ..... *E21B 43/10* (2013.01); *E21B 33/13* (2013.01); *E21B 33/14* (2013.01); *E21B 33/146* (2013.01); *E21B 34/066* (2013.01); *E21B 43/045* (2013.01)

(58) Field of Classification Search
CPC ..... E21B 43/045; E21B 43/10; E21B 33/13; E21B 33/146; E21B 33/14; E21B 34/066
See application file for complete search history.

(56) References Cited

U.S. PATENT DOCUMENTS 3,126,963 A 3/1964 Graham
3,260,309 A * 7/1966 Brown ..... E21B 33/14 166/124

(Continued)

FOREIGN PATENT DOCUMENTS

GB 1063977 A 4/1967
WO 2012100259 A2 7/2012

OTHER PUBLICATIONS

PCT International Search Report and Written Opinion dated Jun. 30, 2015, for International Application No. PCT/US2014/033722.

(Continued)

*Primary Examiner* — Tara Schimpf
(74) *Attorney, Agent, or Firm* — Patterson + Sheridan, LLP

(57) ABSTRACT

A liner deployment assembly (LDA) for use in a wellbore includes: a crossover tool. The crossover tool includes: a seal for engaging a tubular string cemented into the wellbore; a tubular housing carrying the seal and having bypass ports straddling the seal; a mandrel having a bore therethrough and a port in fluid communication with the mandrel bore, the mandrel movable relative to the housing between a bore position where the mandrel port is isolated from the bypass ports and a bypass position where the mandrel port is aligned with one of the bypass ports; a bypass chamber formed between the housing and the mandrel and extending above and below the seal; and a control module. The control module includes: an electronics package; and an actuator in communication with the electronics package and operable to move the mandrel between the positions.

20 Claims, 25 Drawing Sheets

Related U.S. Application Data

(60) Provisional application No. 61/950,421, filed on Mar. 10, 2014, provisional application No. 61/841,058, filed on Jun. 28, 2013, provisional application No. 61/811,007, filed on Apr. 11, 2013.

(51) Int. Cl.

| | |
|---|---|
| ***E21B 33/14*** | (2006.01) |
| ***E21B 34/06*** | (2006.01) |
| ***E21B 43/04*** | (2006.01) |

(56) References Cited

U.S. PATENT DOCUMENTS

| | | | |
|---|---|---|---|
| 3,421,586 | A | 1/1969 | Solum |
| 7,063,148 | B2 | 6/2006 | Jabusch |
| 7,183,239 | B2 | 2/2007 | Smith et al. |
| 7,252,152 | B2 | 8/2007 | LoGiudice et al. |
| 7,306,092 | B1 | 12/2007 | Heinzl et al. |
| 7,857,052 | B2 | 12/2010 | Giroux et al. |
| 8,286,717 | B2 | 10/2012 | Giroux et al. |
| 8,403,078 | B2 | 3/2013 | Brunnert et al. |
| 8,424,842 | B2 | 4/2013 | Bussear |
| 10,087,725 | B2 | 10/2018 | Giroux et al. |
| 2004/0084182 | A1 | 5/2004 | Edgar et al. |
| 2006/0065408 | A1 | 3/2006 | Green et al. |
| 2007/0285275 | A1 | 12/2007 | Purkis et al. |
| 2009/0223663 | A1 | 9/2009 | Snider et al. |
| 2009/0230340 | A1 | 9/2009 | Purkis |
| 2009/0272544 | A1 | 11/2009 | Giroux et al. |
| 2010/0200244 | A1 | 8/2010 | Purkis |
| 2011/0248566 | A1 | 10/2011 | Purkis |
| 2012/0067594 | A1 | 3/2012 | Noske et al. |
| 2012/0279705 | A1 | 11/2012 | Moffitt |
| 2013/0118752 | A1 | 5/2013 | Hannegan et al. |
| 2013/0264068 | A1 | 10/2013 | Hanson et al. |
| 2013/0319691 | A1 | 12/2013 | Thomson et al. |
| 2013/0319767 | A1 | 12/2013 | Wilson et al. |
| 2014/0076563 | A1* | 3/2014 | Lin ..... E21B 33/13 166/295 |
| 2014/0262234 | A1* | 9/2014 | Walton ..... E21B 34/06 166/250.01 |

OTHER PUBLICATIONS

EPO Office Action dated Sep. 10, 2018, for European Patent Application No. 14723648.3.

Canadian Office Action dated Jan. 15, 2020, for Canadian Patent Application No. 2,980,613.

* cited by examiner

TELEMETRY OPERATED TOOLS FOR CEMENTING A LINER STRING

CROSS-REFERENCE TO RELATED APPLICATIONS

This application is a divisional of co-pending U.S. patent application Ser. No. 14/250,162, filed Apr. 10, 2014, which claims benefit of U.S. provisional patent application Ser. No. 61/950,421, filed Mar. 10, 2014, U.S. provisional patent application Ser. No. 61/841,058, filed Jun. 28, 2013, and U.S. provisional patent application Ser. No. 61/811,007, filed Apr. 11, 2013. Each of the aforementioned related patent applications is herein incorporated by reference.

BACKGROUND OF THE DISCLOSURE

Field of the Disclosure

This disclosure relates to telemetry operated tools for cementing a liner string.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

As more casing/liner strings are set in the wellbore, the casing/liner strings become progressively smaller in diameter to fit within the previous casing/liner string. In a drilling operation, the drill bit for drilling to the next predetermined depth must thus become progressively smaller as the diameter of each casing/liner string decreases. Therefore, multiple drill bits of different sizes are ordinarily necessary for drilling operations. As successively smaller diameter casing/liner strings are installed, the flow area for the production of oil and gas is reduced. Therefore, to increase the annulus for the cementing operation, and to increase the production flow area, it is often desirable to enlarge the borehole below the terminal end of the previously cased/lined borehole. By enlarging the borehole, a larger annulus is provided for subsequently installing and cementing a larger casing/liner string than would have been possible otherwise and the bottom of the formation can be reached with comparatively larger diameter casing/liner, thereby providing more flow area for the production of oil and/or gas.

In order to accomplish drilling a wellbore larger than the bore of the casing/liner, a drill string with an underreamer and pilot bit may be employed. Underreamers may include a plurality of arms which may move between a retracted position and an extended position. The underreamer may be passed through the casing/liner, behind the pilot bit when the arms are retracted. After passing through the casing, the arms may be extended in order to enlarge the wellbore below the casing.

SUMMARY OF THE DISCLOSURE

This disclosure relates to telemetry operated tools for cementing a liner string. In one embodiment, a liner deployment assembly (LDA) for use in a wellbore includes: a crossover tool. The crossover tool includes: a seal for engaging a tubular string cemented into the wellbore; a tubular housing carrying the seal and having bypass ports straddling the seal; a mandrel having a bore therethrough and a port in fluid communication with the mandrel bore, the mandrel movable relative to the housing between a bore position where the mandrel port is isolated from the bypass ports and a bypass position where the mandrel port is aligned with one of the bypass ports; a bypass chamber formed between the housing and the mandrel and extending above and below the seal; and a control module. The control module includes: an electronics package; and an actuator in communication with the electronics package and operable to move the mandrel between the positions.

In another embodiment, a method of hanging a liner string from a tubular string cemented in a wellbore includes running the liner string into the wellbore using a workstring having a liner deployment assembly (LDA) while pumping drilling fluid down an annulus formed between the workstring, liner string, and the wellbore and receiving returns up a bore of the workstring and liner string. The LDA includes a crossover tool, a liner isolation valve, and a setting tool. The crossover tool includes a seal engaged with the tubular string and bypass ports straddling the seal. The crossover tool is in a first position. The liner isolation valve is open. The method further includes shifting the crossover tool to a second position by pumping a first tag down the annulus to the LDA.

In another embodiment, a float collar for assembly with a tubular string includes: a tubular housing having a bore therethrough; a receptacle and a shutoff valve each made from a drillable material and disposed in the housing bore; the shutoff valve comprising a pair of oppositely oriented check valves arranged in series; the receptacle having a shoulder carrying a seal for engagement with a stinger to prop the check valves open; and a bleed passage. The bleed passage extends from a bottom of the shutoff valve and along a substantial length thereof so as to be above the shutoff valve, and terminates before reaching a top of the receptacle.

In another embodiment, a liner isolation valve includes a valve module. The valve module includes: a tubular housing for assembly as part of a workstring; a flapper disposed in the housing and pivotable relative thereto between an upwardly open position, a closed position, and a downwardly open position; a flow tube longitudinally movable relative to the housing for propping the flapper in the upwardly open position and covering the flapper in the downwardly open position; and a seat longitudinally movable relative to the housing for engaging the flapper in the closed position. The liner isolation valve further includes a valve control module. The valve control module includes: an electronics package and an actuator in communication with the electronics package and operable to actuate the valve module between the positions.

In another embodiment, a method of performing a wellbore operation includes assembling an isolation valve as part of a tubular string; and deploying the tubular string into the wellbore. A flow tube of the isolation valve props a flapper of the isolation valve in an open position. The method further includes: pressurizing a chamber formed between the flow tube and a housing of the isolation valve, thereby operating a piston of the isolation valve to move the flow tube longitudinally away from the flapper, releasing the flapper, and allowing the flapper to close; and further pressurizing the chamber, thereby separating the piston from the flow tube and moving the flow tube longitudinally toward and into engagement with the closed flapper.

In another embodiment, a method of hanging a liner string from a tubular string cemented in a wellbore includes: spotting a puddle of cement slurry in a formation exposed to the wellbore; and after spotting the puddle, running the liner string into the wellbore using a workstring having a liner deployment assembly (LDA) while pumping drilling fluid down a bore of the workstring and liner string and receiving returns up an annulus formed between the workstring, liner string, and the wellbore. The LDA includes a liner isolation valve (LIV) in an open position, and a setting tool. The method further includes: once a shoe of the liner string reaches a top of the puddle, shifting the LIV to a check position by pumping a first tag down the workstring bore; and once the LIV has shifted, advancing the liner string into the puddle, thereby displacing the cement slurry into the liner annulus and liner bore.

In another embodiment, a method of hanging a liner string from a tubular string cemented in a wellbore includes: running the liner string into the wellbore using a workstring having a liner deployment assembly (LDA); shifting a crossover tool of the LDA by pumping a tag to the LDA; and pumping cement slurry down a bore of the workstring, wherein the crossover tool diverts the cement slurry from the workstring bore and down an annulus formed between the liner string and the wellbore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION OF THE DISCLOSURE

Figure 1A:
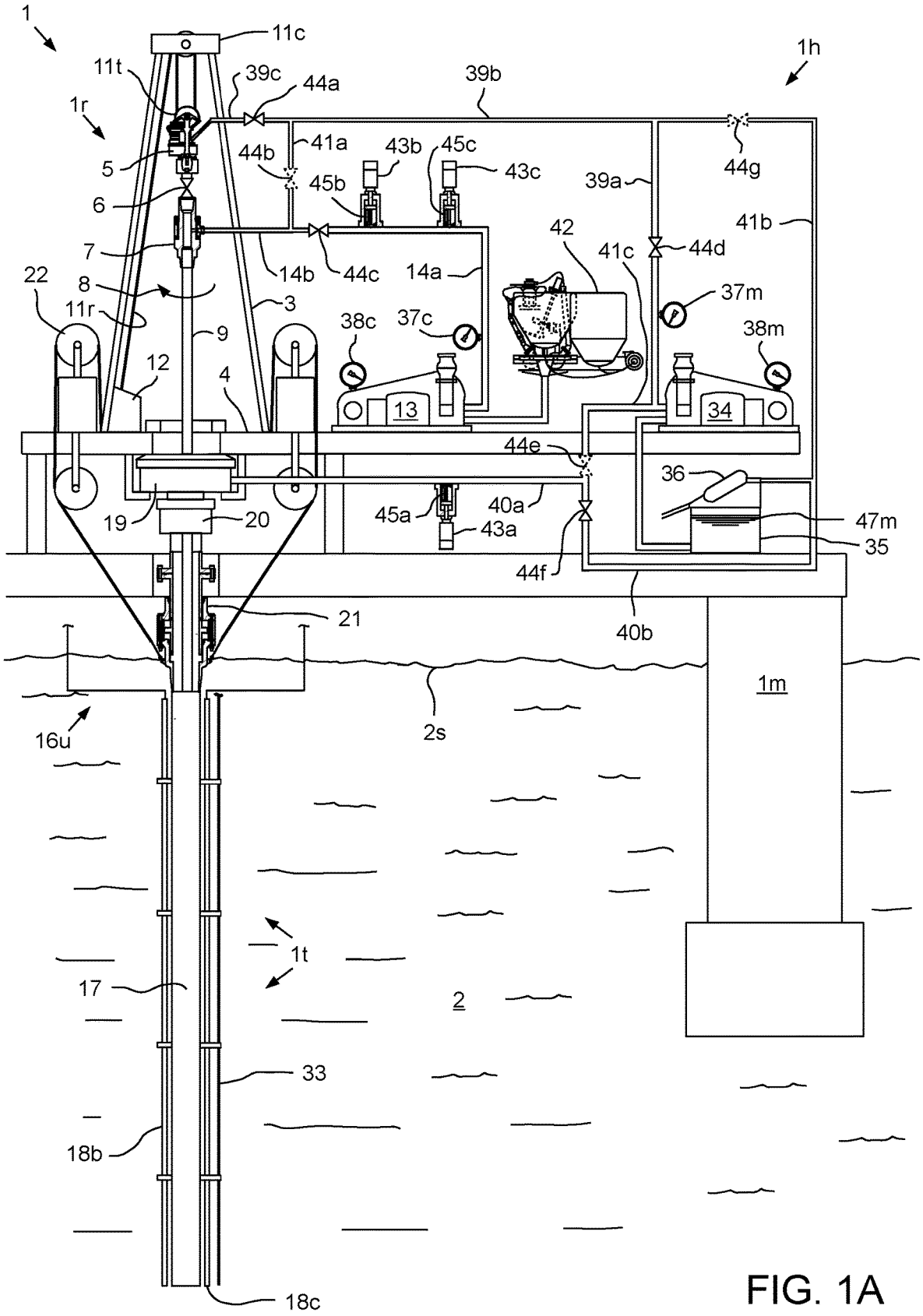
FIGS. 1A-1C illustrate a drilling system in a reverse reaming mode, according to one embodiment of this disclosure.
Figure 1B:
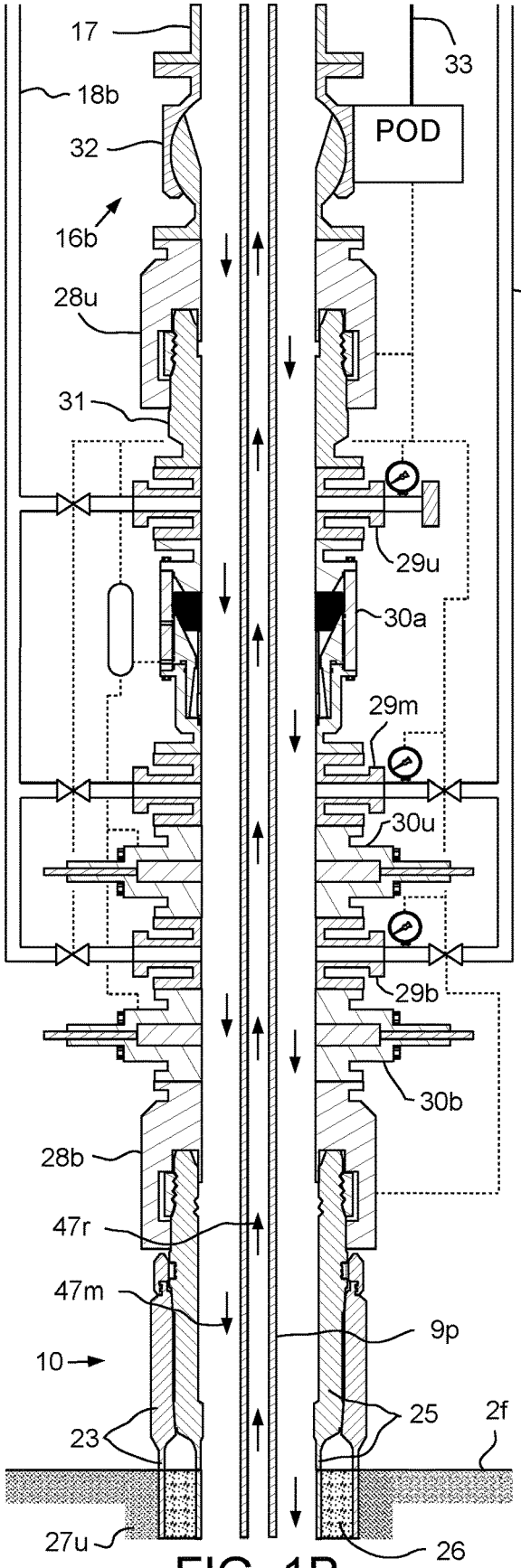
Figure 1C:
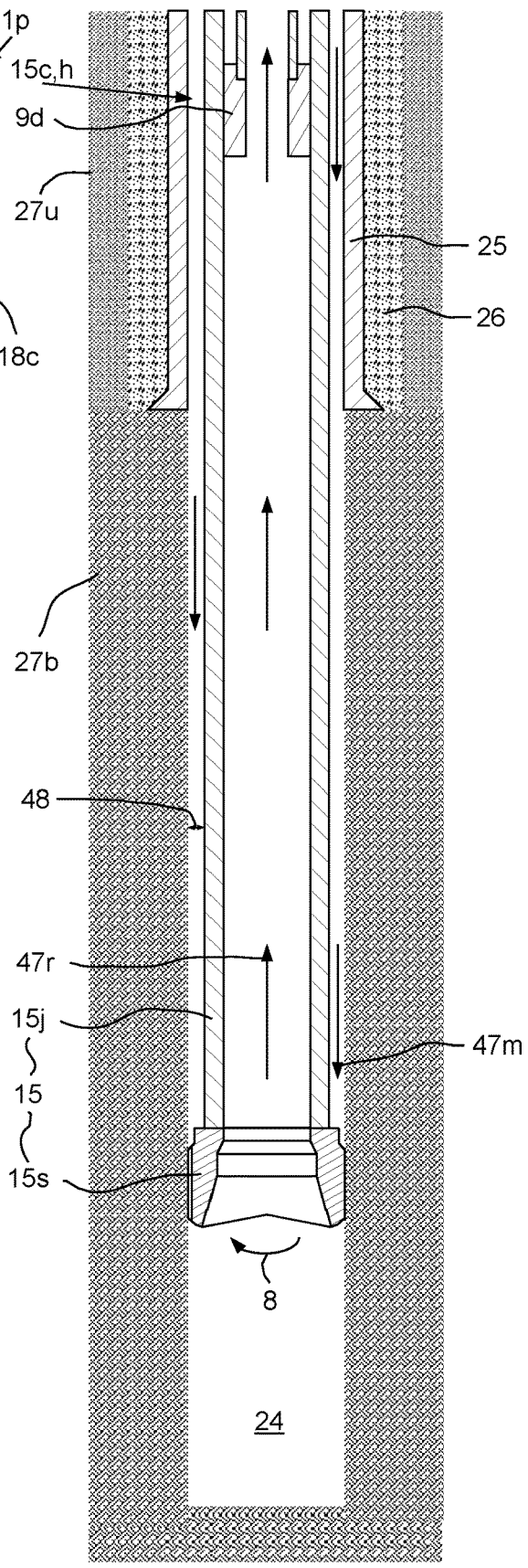

FIGS. 1A-1C illustrate a drilling system in a reverse reaming mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system 1*t*, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, an isolation valve 6, a cementing swivel 7, and a hoist. The top drive 5 may include a motor for rotating 8 the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The frame of the top drive 5 may be suspended from the derrick 3 by the traveling block 11*t*. The isolation valve 6 may be connected to a quill of the top drive 5. The quill may be torsionally driven by the top drive motor and supported from the frame by bearings. The top drive may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

Alternatively, a Kelly and rotary table may be used instead of the top drive.

The cementing swivel 7 may include a housing torsionally connected to the derrick 3, such as by bars, wire rope, or a bracket (not shown). The torsional connection may accommodate longitudinal movement of the swivel 7 relative to the derrick 3. The swivel 7 may further include a mandrel and bearings for supporting the housing from the mandrel while accommodating rotation 8 of the mandrel. The mandrel may also be connected to the isolation valve 6. The cementing swivel 7 may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. Each seal assembly may include one or more stacks of V-shaped seal rings, such as opposing stacks, disposed between the mandrel and the housing and straddling the inlet-port interface. Alternatively, the seal assembly may include rotary seals, such as mechanical face seals.

An upper end of the workstring 9 may be connected to the cementing swivel 7. The workstring 9 may include a liner deployment assembly (LDA) 9*d* and a deployment string, such as joints of drill pipe 9*p* connected together, such as by threaded couplings. An upper end of the LDA 9*d* may be connected a lower end of the drill pipe 9*p*, such as by a threaded connection. The LDA 9*d* may also be connected to a liner string 15. The liner string 15 may include a liner hanger 15*h*, a float collar 15*c*, joints of liner 15*j*, and a reamer shoe 15*s*. The liner string members may each be connected together, such as by threaded couplings. The reamer shoe 15*s* may be rotated 8 by the top drive 5 via the workstring 9.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 21, such as by a flanged connection. The diverter 21 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

Alternatively, the casing string may be anchored to the wellbore by radial expansion thereof instead of cement.

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump (not shown). A lower end of the choke line 18*c* may have prongs connected to respective second branches of the flow crosses 29*m,b*. Shutoff valves may be disposed in respective prongs of the choke line lower end.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33 may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extended between the MODU and the PCA independently of the riser. Alternatively, the shutoff valve actuators may be electrical or pneumatic.

The fluid handling system 1*h* may include one or more pumps, such as a cement pump 13 and a mud pump 34, a reservoir for drilling fluid 47*m*, such as a tank 35, a solids separator, such as a shale shaker 36, one or more pressure gauges 37*c,m*, one or more stroke counters 38*c,m*, one or more flow lines, such as cement line 14*a,b*; mud line 39*a-c*, return line 40*a,b*, reverse spools 41*a-c*, a cement mixer 42, and one or more tag launchers 43*a-c*. The drilling fluid 47*m* may include a base liquid. The base liquid may be refined or synthetic oil, water, brine, or a water/oil emulsion. The drilling fluid 32 may further include solids dissolved or suspended in the base liquid, such as organophilic clay, lignite, and/or asphalt, thereby forming a mud.

A first end of the return line 40*a,b* may be connected to the diverter outlet, a second end of the return line may be connected to an inlet of the shaker 36, and a connection to a lower end of the reverse spool 41*c* may divide the return line into segments 40*a,b*. A shutoff valve 44*f* may be assembled as part of the second return line segment 40*b* and a first tag launcher 44*a* may be assembled as part of the first return line segment 40*a*. A lower end of the mud line 39*a-c* may be connected to an outlet of the mud pump 34, an upper end of the mud line may be connected to the top drive inlet, and connections to upper ends of the reverse spools 41*a,b* may divide the return line into segments 39*a-c*. A shutoff valve 44*a* may be assembled as part of the third mud line segment 39*c* and a shutoff valve 44*d* may be assembled as part of the first mud line segment 39*a*. An upper end of the cement line 14*a,b* may be connected to the cementing swivel inlet, a lower end of the cement line may be connected to an outlet of the cement pump 13, and a connection to a lower end of the reverse spool 41*a* may divide the cement line into segments 14*a,b*. A shutoff valve 44*c* and second and third tag launchers 43*b,c* may be assembled as part of the first cement line segment 14*a*. A shutoff valve 44*b* may be assembled as part of the first reverse spool 41*a*. A lower end of the second reverse spool 41*b* may be connected to the shaker inlet and a shutoff valve 44*g* may be assembled as part thereof. An upper end of the third reverse spool 41*c* may be connected to the mud pump outlet and a shutoff valve 44*e* may be assembled as part thereof. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

Each tag launcher 43*a-c* may include a housing, a plunger, an actuator, and a magazine (not shown) having a plurality of respective radio frequency identification (RFID) tags 45*a-c* loaded therein. A respective chambered RFID tag 45*a-c* may be disposed in the respective plunger for selective release and pumping downhole to communicate with LDA 9*d*. The plunger of each launcher 43*a-c* may be movable relative to the respective launcher housing between a captured position and a release position. The plunger may be moved between the positions by the actuator. The actuator may be hydraulic, such as a piston and cylinder assembly.

Alternatively, the actuator may be electric or pneumatic. Alternatively, the actuator may be manual, such as a handwheel. Alternatively, the tags may be manually launched by breaking a connection in the respective line.

Figures 7A, 7B, 7C, 7D, 7E:
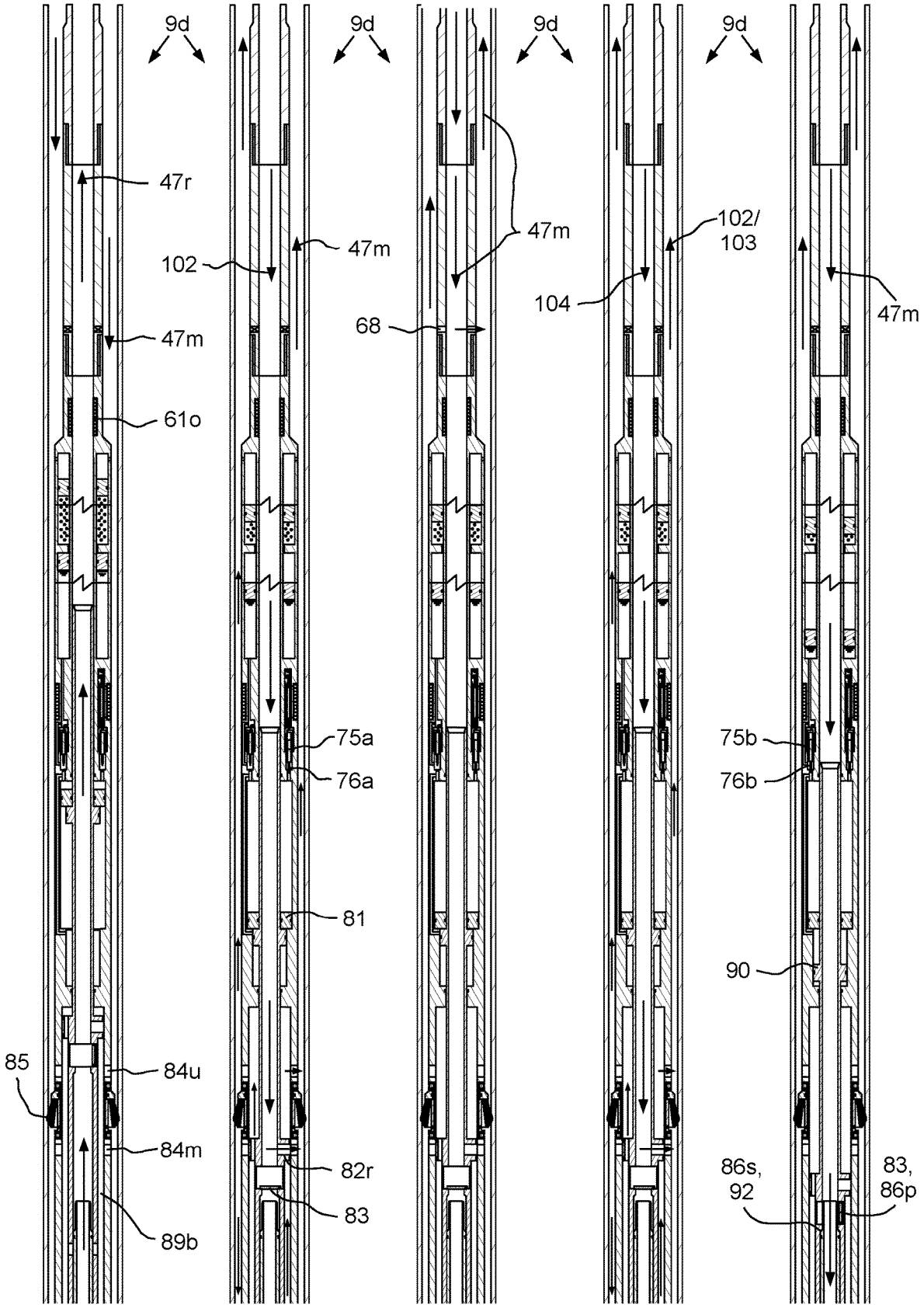
FIGS. 7A-7E and 9A-9D illustrate operation of an upper portion of the LDA.
Figures 8A, 8B, 8C, 8D, 8E:
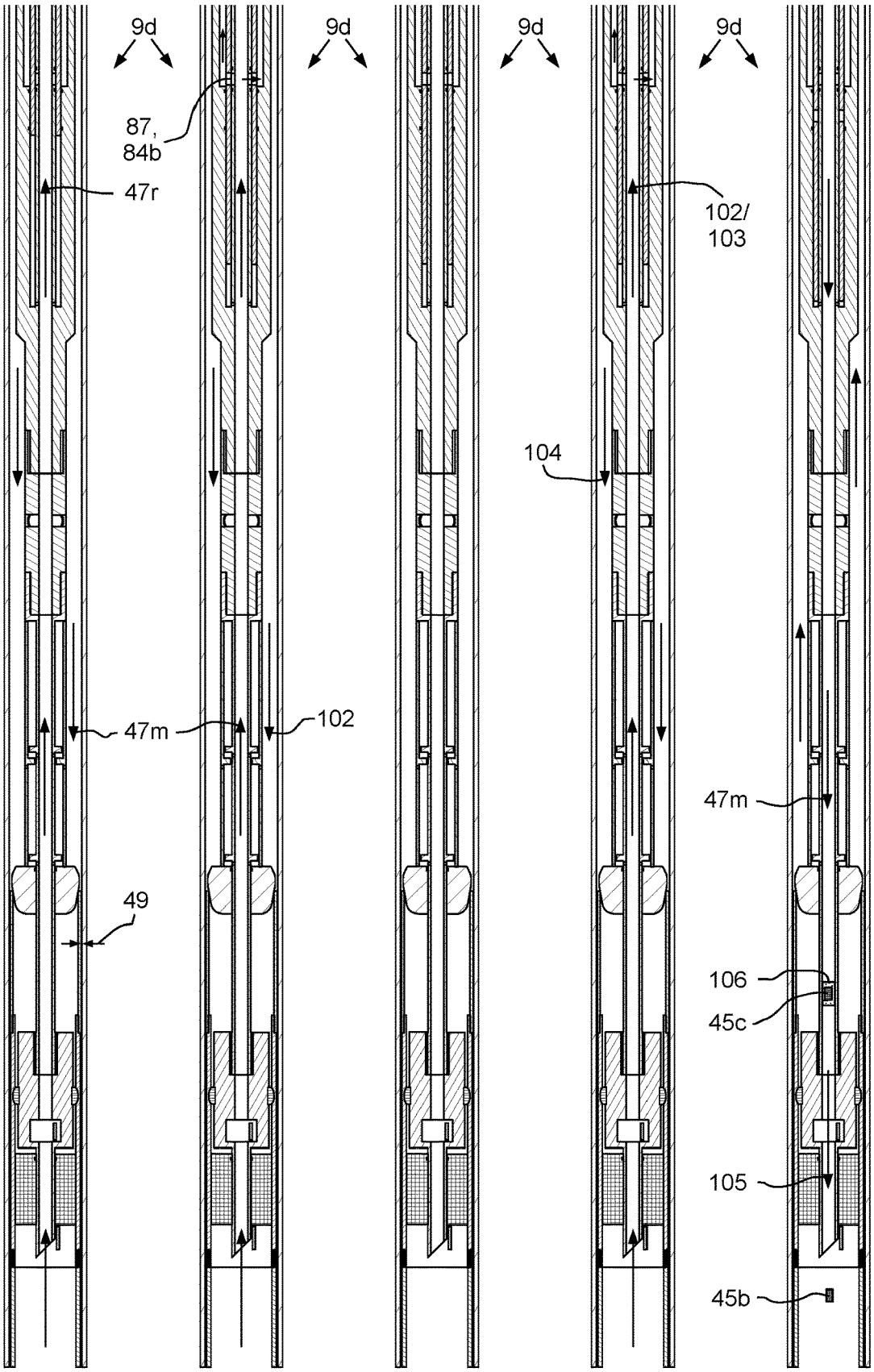
FIGS. 8A-8E and 10A-10D illustrate operation of a lower portion of the LDA.

Referring also to FIGS. 7A and 8A, to ream the liner string 15 into the lower formation 22*b*, the mud pump 34 may pump drilling fluid 47*m* from the tank 35, through reverse spool 41*c* and open valve 44*e* into the first return line segment 40*a*. The drilling fluid 47*m* may flow into the diverter 19 and down an annulus formed between the riser 17 and the drill pipe 9*p*. The drilling fluid 47*m* may flow through annuli of the PCA 1*p* and wellhead 10 and into an annulus 48 formed between the workstring 9/liner string 15 and the casing string 25/wellbore 24. The drilling fluid 32 may exit the annulus 48 through courses of the reamer shoe 15*s*, where the fluid may circulate cuttings away from the shoe and return the cuttings into a bore of the liner string 15. The returns 47*r* (drilling fluid plus cuttings) may flow up the liner bore and into a bore of the workstring 9. The returns 47*r* may flow up the workstring bore and into the cementing swivel 7. The returns 47*r* may be diverted into the second cement line segment 14*b* by the closed isolation valve 6. The returns 47*r* may flow from the second cement line segment 14*b* and into the second mud line segment 39*b* via the first reverse line spool 41*a* and open valve 44*b*. The returns 47*r* may flow from the second mud line segment 39*b* and into the shale shaker inlet via the second reverse line spool 41*b* and open valve 44*g*. The returns 47*r* may be processed by the shale shaker 36 to remove the cuttings, thereby completing a cycle. As the drilling fluid 47*m* and returns 47*r* circulate, the workstring 9 may be rotated 8 by the top drive 5 and lowered by the traveling block 11*t*, thereby reaming the liner string 15 into the lower formation 27*b*.

Reverse flow reaming the liner string 15 into the lower formation 27*b* may avoid excessive pressure which would otherwise be exerted thereon by the returns 47*r* being choked through a narrow clearance 49 (FIG. 8A) formed between an outer surface of the liner hanger 15*h* and an inner surface of the casing 25. This dynamic pressure is typically expressed as an equivalent circulating density (ECD) of the returns 47*r*.

Figure 3A:
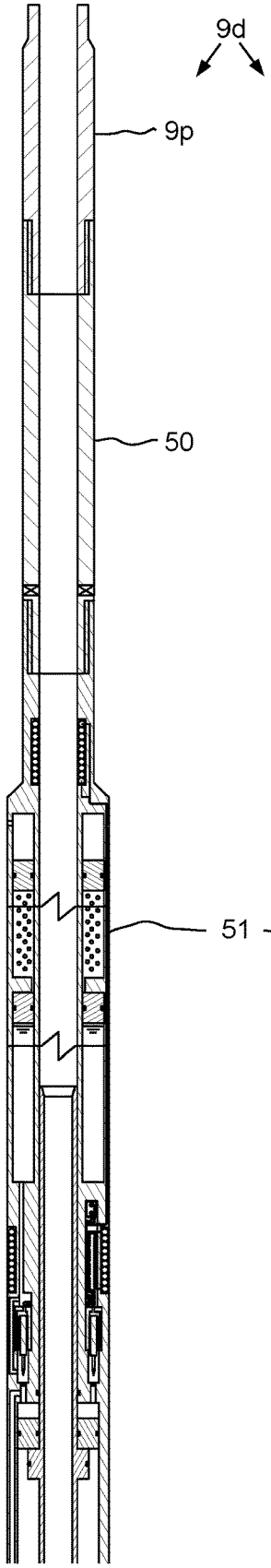
FIGS. 3A-3C illustrate a liner deployment assembly (LDA) of the drilling system.
Figure 3B:
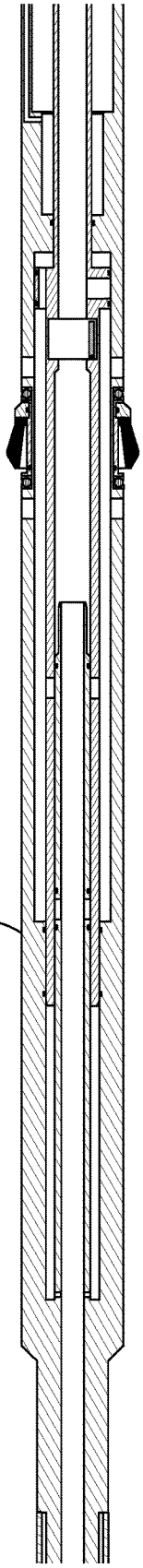
Figure 3C:
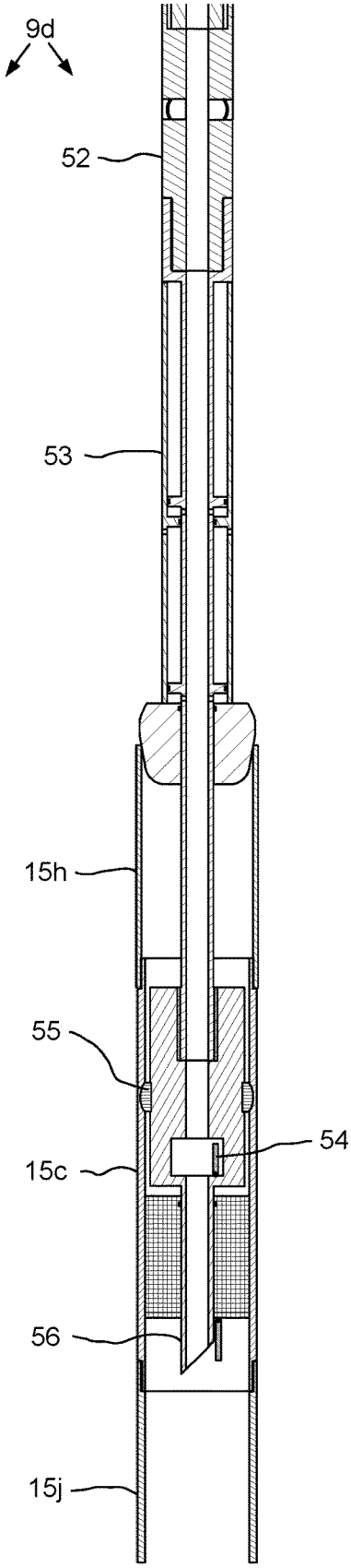

FIGS. 3A-3C illustrate the LDA 9*d*. The LDA 9*d* may include a circulation sub 50, a crossover tool 51, a flushing sub 52, a setting tool, such as expander 53, a liner isolation valve 54, a latch 55, and a stinger 56. The LDA members 50-56 may be connected to each other, such as by threaded couplings.

The liner hanger 15*h* may be an expandable liner hanger and the expander 53 may be operable to radially and plastically expand the liner hanger 15*h* into engagement with the casing 25. The expander 53 may include a connector sub, a mandrel, a piston assembly, and a cone. The connector sub may be a tubular member having an upper threaded coupling for connecting to the flushing sub and a longitudinal bore therethrough. The connector sub may also have a lower threaded coupling engaged with a threaded coupling of the mandrel. The mandrel may be a tubular member having a longitudinal bore therethrough and may include one or more segments connected by threaded couplings.

The piston assembly may include a piston, upper and lower sleeves, a cap, an inlet, and an outlet. The piston may be a T-shaped annular member. An inner surface of the piston may engage an outer surface of the mandrel and may include a recess having a seal disposed therein. The inlet may be formed radially through a wall of the mandrel and provide fluid communication between a bore of the mandrel and an upper face of the piston. Each sleeve may be connected to the piston, such as by threaded couplings. A seal may be disposed between the piston and each sleeve. Each sleeve may be a tubular member having a longitudinal bore formed therethrough and may be disposed around the mandrel, thereby forming an annulus therebetween. The cap may be an annular member, disposed around the mandrel, and connected thereto, such as by threaded couplings. The cap may also be disposed about a shoulder formed in an outer surface of the mandrel. Seals may be disposed between the cap and the mandrel and between the cap and the sleeves. An upper end of the upper sleeve may be exposed to the annulus 48. The outlet may be formed through an outer surface of the piston and may provide fluid communication between a lower face of the piston and the annulus 48. A lower end of the lower sleeve may be connected to the cone, such as by threaded couplings. One of the sleeves may also be fastened to the mandrel at by one or more shearable fasteners.

The cone may include a body, one or more segments, a base, one or more retainers, a sleeve, a shoe, a pusher, and one or more shearable fasteners. The cone may be driven through the liner hanger 15*h* by the piston. The pusher may be connected to the cone sleeve, such as by threaded couplings. The pusher may also be fastened to the body by the shearable fasteners. The cone segments may each include a lip at each end thereof in engagement with respective lips formed at a bottom of an upper retainer and a top of a lower retainer, thereby radially connecting the cone segments to the retainers. An inner surface of each cone segment may be inclined for mating with an inclined outer surface of the cone base, thereby holding each cone radially outward into engagement with the retainers. The cone body may be tubular, disposed along the mandrel, and longitudinally movable relative thereto. The upper retainer may be connected to the body, such as by threaded couplings. The retainers, sleeve, and shoe may be disposed along the body. The upper retainer may abut the cone base and the cone segments. The cone segments may abut the lower retainer. The lower retainer may abut the cone sleeve and the sleeve may abut the shoe. The cone shoe may be connected to the cone body, such as by threaded couplings.

The expandable liner hanger 15*h* may include a tubular body made from a ductile material capable of sustaining plastic deformation, such as a metal or alloy. The hanger 15*h* may include one or more seals disposed around an outer surface of the body. The hanger may also have a hard material or teeth embedded/formed in one or more of the seals and/or an outer surface of the hanger body for engaging an inner surface of the casing 25 and/or supporting the seals.

In operation (FIG. 10B), movement of the piston sleeves downward toward the upper cone retainer may fracture the piston and cone shearable fasteners since the cone body may be retained by engagement of the cone segments with a top of the liner hanger 15*h*. Failure of the cone shearable fasteners may free the pusher for downward movement toward the upper retainer until a bottom of the pusher abuts a top of the upper retainer. Continued movement of the piston sleeves may then push the cone segments through the liner hanger 15*h*, thereby expanding the liner hanger into engagement with the casing 25.

Alternatively, the cone or portions thereof may be released from the expander after expansion of the liner hanger to serve as reinforcement for the liner hanger.

Alternatively, the liner hanger may include an anchor and a packoff. The anchor may be operable to engage the casing and longitudinally support the liner string from the casing. The anchor may include slips and a cone. The anchor may accommodate rotation of the liner string relative to the casing, such as by including a bearing. The packoff may be operable to radially expand into engagement with an inner surface of the casing, thereby isolating the liner-casing interface. The setting tool may be operable to set the anchor and packoff independently. The setting tool may be operable to drive the slips onto the cone and compress the packoff. The anchor may be set before cementing and the packoff may be set after cementing.

The float collar 15*c* may include a tubular housing and a check valve. The housing may be tubular, have a bore formed therethrough, and have a profile for receiving the latch 55. The check valve may be disposed in the housing bore and connected to the housing by bonding with a drillable material, such as cement. The check valve may be made from a drillable material, such as metal or alloy or polymer. The check valve may include a body and a valve member, such as a flapper, pivotally connected to the body and biased toward a closed position, such as by a torsion spring. The flapper may be oriented to allow fluid flow from the liner hanger 15*h* into the liner bore and prevent reverse flow from the liner bore into the liner hanger. The flapper may be propped open by the stinger 56. Once the stinger 56 is removed (FIG. 10C), the flapper may close to prevent flow of cement slurry from the annulus into the liner bore.

Alternatively, the float collar may be located at other locations along the liner string, such as adjacent to the reamer shoe 15*s*, the liner string may further include a second float collar, or the float valve may be integrated into the reamer shoe.

The latch 55 may longitudinally and torsionally connect the liner string 15 to the LDA 9*d*. The latch 55 may include a piston, a stop, a release, a longitudinal fastener, such as a collet, a cap, a case, a spring, one or more sets of one or more shearable fasteners, an override, a body, a catch, and one or more torsional fasteners. The override and the latch body may each be tubular, have a bore therethrough, and include a threaded coupling formed at each end thereof. An upper end of the override may be connected to the expander 53 and a lower end of the override may be connected to an upper end of the latch body, such as by threaded couplings. A lower end of the latch body may be connected to the liner isolation valve 54, such as by threaded couplings. The release may be connected to the override at a mid portion thereof, such as by threaded couplings. The threaded couplings may be oppositely oriented (i.e. left-hand) relative to other threaded connections of the LDA 9*d*. The release may be longitudinally biased away from the override by engagement of the spring with a first set of the shearable fasteners.

The collet may have a plurality of fingers each having a lug formed at a bottom thereof. The finger lugs may engage a complementary portion of the float collar latch profile, thereby longitudinally connecting the latch to the float collar. Keys and keyways may be formed in an outer surface of the release. The keys and keyways may engage a complementary keyed portion of the float collar latch profile, thereby torsionally connecting the latch to the float collar.

The collet, case, and cap may be longitudinally movable relative to the latch body between the stop and a top of the latch piston. The latch piston may be fluidly operable to release the collet fingers when actuated by a threshold release pressure. The latch piston may be fastened to the latch body by a second set of the shearable fasteners. Once the liner hanger 15*h* has been expanded into engagement with the casing 25 and weight of the liner string 15 is supported by the liner hanger 15*h*, fluid pressure may be increased. The fluid pressure may push the latch piston and fracture the second set of shearable fasteners, thereby releasing the latch piston. The latch piston may then move upward toward the collet until the piston abuts a bottom of the collet. The latch piston may continue upward movement while carrying the collet, case, and cap upward until a bottom of the release abuts the fingers, thereby pushing the fingers radially inward. The catch may be a split ring biased radially inward and disposed between the collet and the case. The latch body may include a recess formed in an outer surface thereof. During upward movement of the latch piston, the catch may align and enter the recess, thereby forming a downward stop preventing reengagement of the fingers. Movement of the latch piston may continue until the cap abuts the stop, thereby ensuring complete disengagement of the fingers.

Figures 4A, 4B, 4C:
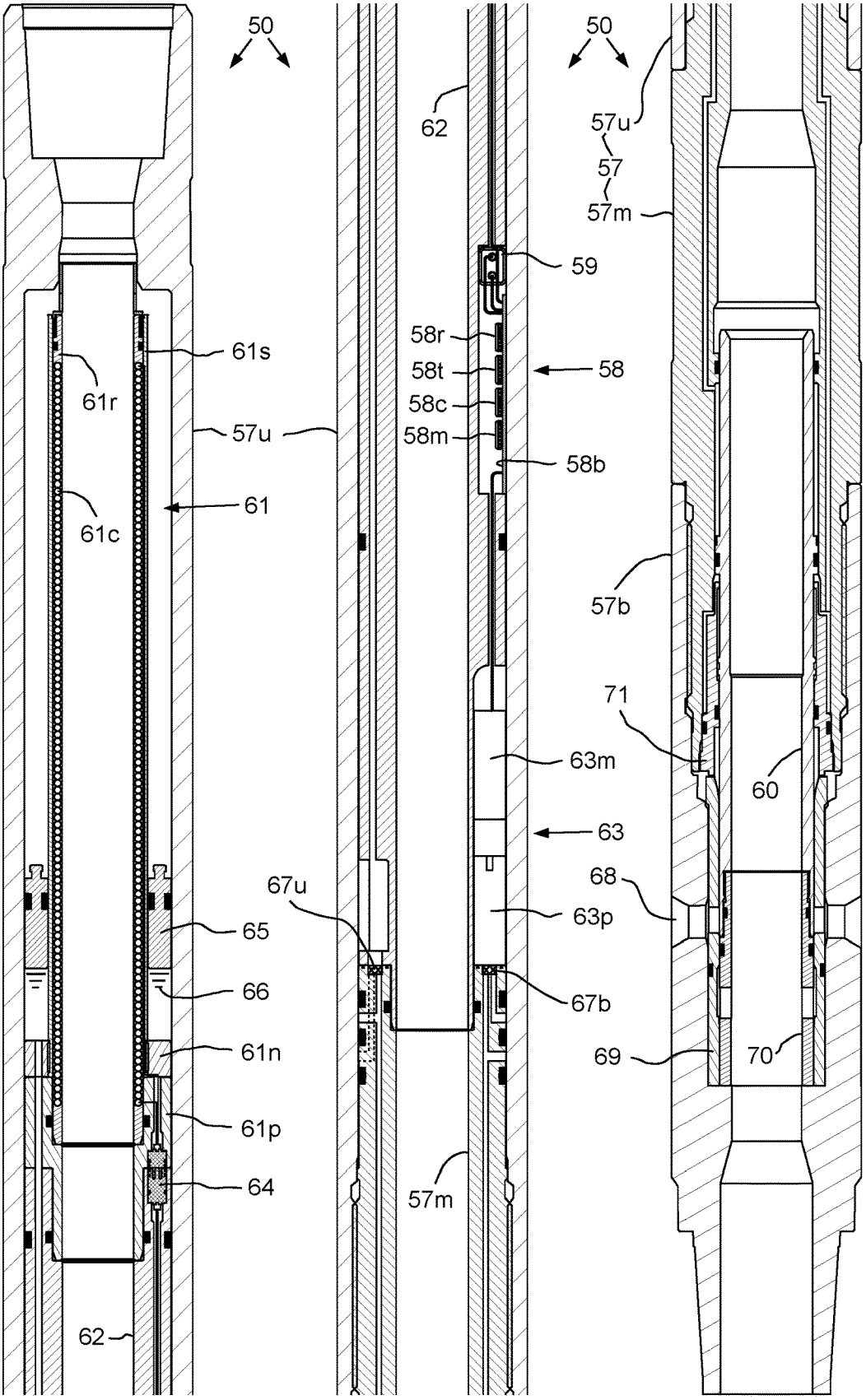
FIGS. 4A-4C illustrate a circulation sub of the LDA.
Figures 5A, 5B, 5C:
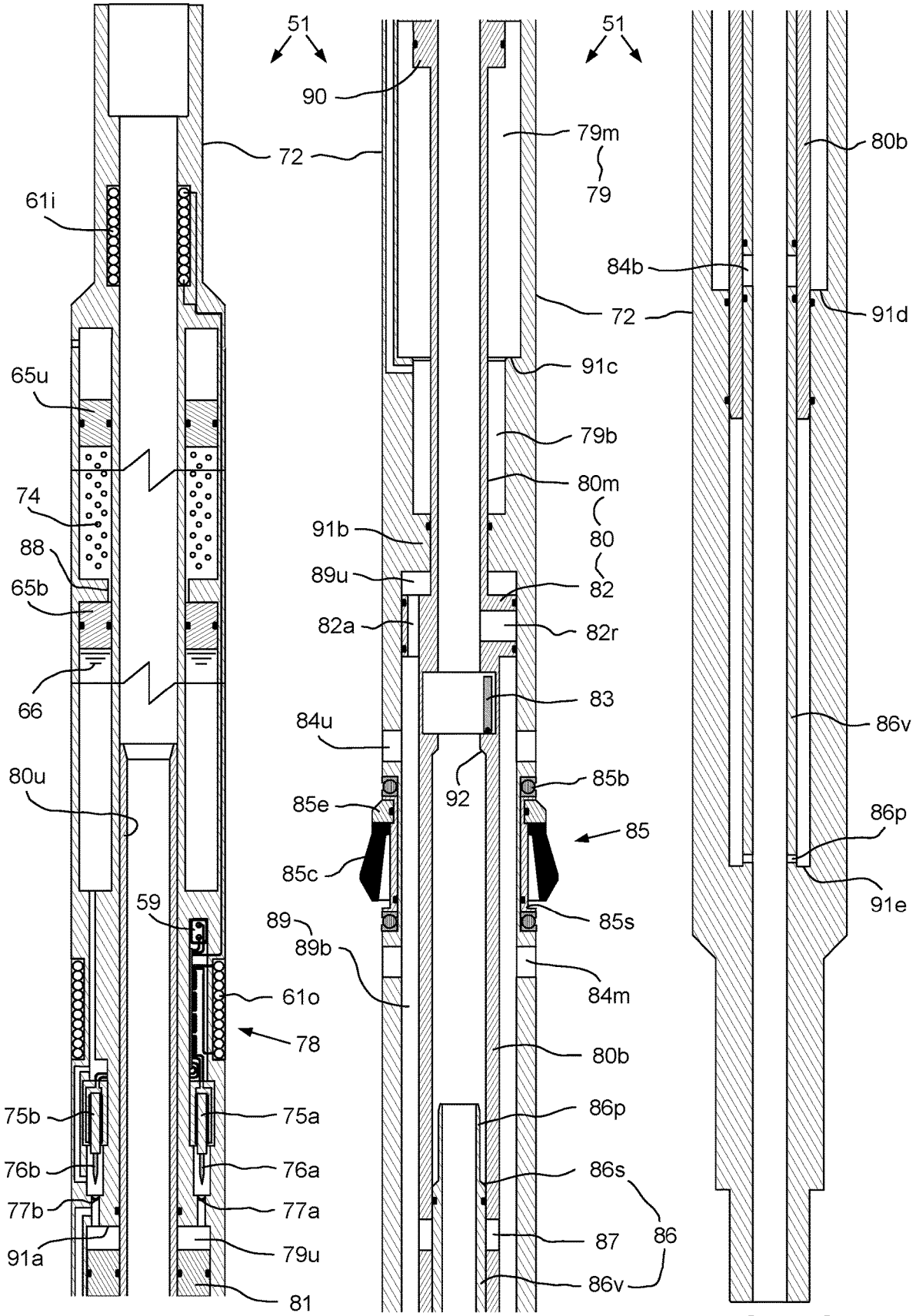

FIGS. 4A-4C illustrate the circulation sub 50. The circulation sub 50 may include a housing 57, an electronics package 58, a power source, such as a battery 59, a piston 60, an antenna 61, a mandrel 62, and an actuator 63. The housing 57 may include two or more tubular sections 57*u,m,b* connected to each other, such as by threaded couplings. The housing 57 may have couplings, such as threaded couplings, formed at each longitudinal end thereof for connection to the drill pipe 9*p* at an upper end thereof and the crossover tool 51 at a lower end thereof. The housing 57 may have a pocket formed between the upper 57*u* and mid 57*m* sections thereof for receiving the antenna 61 and the mandrel 62.

The antenna 61 may include an inner liner 61*r*, a coil 61*c*, an outer sleeve 61*s*, nut 61*n*, and a plug 61*p*. The liner 61*r* may be made from a non-magnetic and non-conductive material, such as a polymer or composite, have a bore formed longitudinally therethrough, and have a helical groove formed in an outer surface thereof. The coil 61*c* may be wound in the helical groove and made from an electrically conductive material, such as copper or alloy thereof. The outer sleeve 61*s* may be made from the non-magnetic and non-conductive material and may insulate the coil 61*c*. A seal may be disposed in an upper interface of the liner 61*r* and the sleeve 61*s*. The nut 61*n* and plug 61*p* may each be made from the non-magnetic and non-conductive material and may receive ends of the coil 61*c*.

The nut 61*n* may be connected to the sleeve 61*s*, such as by threaded connection, and the plug 61*p* may be connected to the liner 61*r*, such as one or more threaded fasteners (not shown). A seal may be disposed in an interface of the liner 61*r* and the plug 61*p*. The plug 61*p* may have an electrical conduit formed therethrough for receiving the coil ends and receiving a socket 64 disposed in an upper end of the mandrel 62. A seal may be disposed in an interface of the mandrel 62 and the plug 61*p*. A balance piston 65 may be disposed in a reservoir chamber formed between upper housing section 57*u* and the antenna sleeve 61*s* and may divide the chamber into an upper portion and a lower portion. One or more ports may provide fluid communication between the reservoir chamber upper portion and a bore of the circulation sub 50. Hydraulic fluid, such as oil 66 may be disposed in the reservoir chamber lower portion. The balance piston 65 may carry inner and outer seals for isolating the hydraulic oil 66 from a bore of the circulation sub 50. Each of the nut 61*n* and the plug 61*p* may have a hydraulic passage formed therethrough.

The mandrel 62 may be a tubular member having one or more recesses formed in an outer surface thereof. The mandrel 62 may be connected to the mid housing section 57*m*, such as by one or more threaded fasteners (not shown). The mandrel may have an electrical conduits formed in a wall thereof for receiving lead wires connecting the socket 64 to the electronics package 58 and connecting the battery 59 to the electronics package 58. The mandrel 62 may also have a hydraulic passage formed therethrough for providing fluid communication between the reservoir and the actuator 63. One or more seals may be disposed in an interface between the upper housing section 57*u* and the mandrel 62. The mandrel may have another electrical conduit formed in the wall thereof for receiving lead wires connecting the electronics package to the actuator 63.

The electronics package 58 and battery 59 may be disposed in respective recesses of the mandrel 62. The electronics package 58 may include a control circuit 58*c*, a transmitter 58*t*, a receiver 58*r*, and a motor controller 58*m* integrated on a printed circuit board 58*b*. The control circuit 58*c* may include a microcontroller (MCU), a memory unit (MEM), a clock, and an analog-digital converter. The transmitter 58*t* may include an amplifier (AMP), a modulator (MOD), and an oscillator (OSC). The receiver 58*r* may include an amplifier (AMP), a demodulator (MOD), and a filter (FIL). The motor controller 58*m* may include an inverter for converting a DC power signal supplied by the battery 59 into a suitable power signal for driving an electric motor 63*m* of the actuator 63.

Figure 2A:
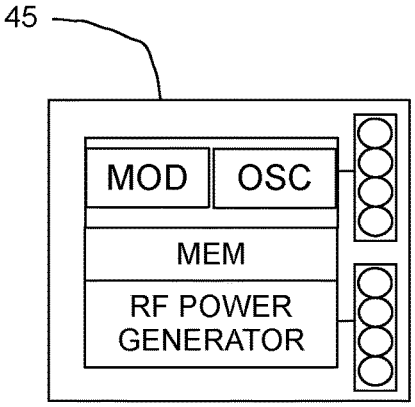
FIG. 2A illustrates a radio frequency identification (RFID) tag of the drilling system.

FIG. 2A illustrates one 45 of the RFID tags 45*a-c*. Each RFID tag 45*a-c* may be a passive tag and include an electronics package and one or more antennas housed in an encapsulation. The electronics package may include a memory unit, a transmitter, and a radio frequency (RF) power generator for operating the transmitter. The RFID tag 45*a* may be programmed with a command signal addressed to the crossover tool 51. The RFID tag 45*b* may be programmed with a command signal addressed to the circulation sub 50. The RFID tag 45*c* may be programmed with a command signal addressed to the liner isolation valve 54. Each RFID tag 45*a-c* may be operable to transmit a wireless command signal, such as a digital electromagnetic command signal to the respective antennas 61*i,o*, 61. The MCU 58*c* may receive the command signal 58*c* and operate the actuator 63 in response to receiving the command signal.

Figure 2B:
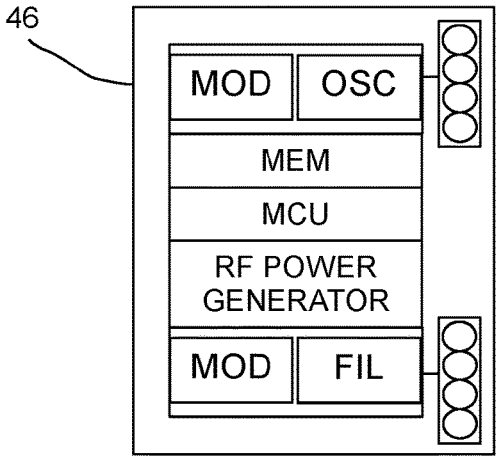
FIG. 2B illustrates an alternative RFID tag.

FIG. 2B illustrates an alternative RFID tag 46. Alternatively, each RFID tag 45*a-c* may be a wireless identification and sensing platform (WISP) RFID tag 46. The WISP tag 46 may further a microcontroller (MCU) and a receiver for receiving, processing, and storing data from the respective LDA component 50, 51, 54. Alternatively, each RFID tag may be an active tag having an onboard battery powering a transmitter instead of having the RF power generator or the WISP tag may have an onboard battery for assisting in data handling functions.

Returning to FIGS. 4A-4C, the actuator 63 may include the electric motor 63*m*, a pump 63*p*, one or more control valves 67*u,b*, and one or more pressure sensors (not shown). The electric motor 63*m* may include a stator in electrical communication with the motor controller 58*m* and a head in electromagnetic communication with the stator for being driven thereby. The motor head may be longitudinally or torsionally driven. The pump 63*p* may have a stator connected to the motor stator and a head connected to the motor head for being driven thereby. The pump head may be longitudinally or torsionally driven. The pump 63*p* may have an inlet in fluid communication with the mandrel hydraulic passage and an outlet in fluid communication with a first control valve 67*u*. The second control valve 67*b* may also be in fluid communication with the mandrel hydraulic passage.

The piston 60 may be disposed in the housing 57 and longitudinally movable relative thereto between an upper position (not shown) and a lower position (shown). The piston may be stopped in the lower position against a shoulder formed in an inner surface of the lower housing section 57*b*. The lower housing section 57*b* may have one or more circulation ports 68 formed through a wall thereof. A liner 69 may be disposed between the piston 60 and the lower housing section 57*b*. The liner 69 may have one or more ports formed therethrough in alignment with the circulation ports 68. The liner 69 may be made from an erosion resistant material, such as a metal, alloy, ceramic, or cermet. A seal may be disposed in an interface between the liner and the lower housing section 57*b*.

A valve sleeve 70 may be connected to a lower end of the piston 60, such as by threaded couplings. A seal may be disposed in the interface between the valve sleeve 70 and the piston. The valve sleeve 70 may have one or more ports formed therethrough corresponding to the circulation ports 68. The valve sleeve 70 may also carry a seal adjacent to the ports thereof in engagement with an inner surface of the liner 69. The valve sleeve/piston interface may cover the liner ports when the piston 60 is in the lower position, thereby closing the circulation ports 68 and the valve sleeve ports may be aligned with the circulation ports when the piston is in the upper position, thereby opening the circulation ports.

A latch 71 may be disposed between the housing and the piston and connected to a lower end of the mid housing section 57*m*, such as by threaded couplings. A seal may be disposed in an inner surface of the latch 71 in engagement with an outer surface of the piston 60. A seal may be disposed in an interface between the mid housing section 57*m* and the latch 71 and may serve as a lower end of an actuation chamber. A shoulder formed in an outer surface of the piston 60 may be disposed in the actuation chamber and carry a seal in engagement with an inner surface of the mid housing section 57*m*. The piston shoulder may divide the actuation chamber into an opener portion and a closer portion. A shoulder formed in an inner surface of the mid housing section 57*m* may have a seal in engagement with an outer surface of the piston 60 and may serve as an upper end of the actuation chamber. Collet fingers may be formed in an upper end of the latch 71. The piston 60 may have a latch profile formed in an outer surface thereof complementary to the collet fingers. Engagement of the fingers with the latch profile may stop the piston 60 in the upper position.

Each end of the actuation chamber may be in fluid communication with a respective control valve 67*u,b* via a respective hydraulic passage formed in a wall of the mid housing section 57*m*. Each control valve 67*u,b* may also be in fluid communication with an opposite hydraulic passage via a crossover passage. The control valves 67*u,b* may each be electronically actuated, such as by a solenoid, and together may provide selective fluid communication between an outlet of the pump and the opener and closer portions of the actuation chamber while providing fluid communication between the reservoir chamber and an alternate one of the opener and closer portions of the actuation chamber. Each control valve actuator may be in electrical communication with the MCU 58*c* for control thereby. A pressure sensor may be in fluid communication with each of the reservoir chamber and another pressure senor may be in fluid communication with an outlet of the pump and each pressure sensor may be in electrical communication with the MCU 58*c* to indicate when the piston has reached the respective upper and lower positions by detecting a corresponding pressure increase at the outlet of the pump 60*p*.

Alternatively, the circulation sub may further include a well control valve or a diverter valve for selectively closing a bore of the circulation sub below the circulation ports. The well control valve may be linked to the valve sleeve such that the well control valve is propped open when the circulation ports are closed and the well control valve is free to function as an upwardly closing check valve when the circulation ports are open. The diverter valve may be a shutoff valve linked to the valve sleeve such that the diverter valve is open when the circulation ports are closed and vice versa.

FIGS. 5A-5D illustrate the crossover tool 51. The crossover tool 51 may include a housing 72, an electronics package 78, a power source, such as the battery 59, a mandrel 80, one or more antennas, such as inner antenna 61*i* and outer antenna 61*o*, one or more actuators, a check valve 83, and a rotary seal 85. The housing 72 may include two or more tubular sections (not shown) connected to each other, such as by threaded couplings. The housing 72 may have couplings, such as threaded couplings, formed at each longitudinal end thereof for connection to the circulation sub 50 at an upper end thereof and the flushing sub 52 at a lower end thereof. The housing 72 may have recesses formed therein for receiving the antennas 61*i,o*, the electronics package 78, and the battery 59. Each antenna 61*i,o* may be similar to the circulation sub antenna 61. The electronics package 78 may be similar to the circulation sub electronics package except for replacement of the motor controller by a solenoid controller.

The mandrel 80 may be tubular and have a longitudinal bore formed therethrough. The mandrel 80 may be disposed in the housing 72 and longitudinally movable relative thereto from a reverse bore position (shown) to a bypass position (FIGS. 7B and 8B) and then to a forward bore position (FIGS. 7E and 8E). The mandrel 80 may be fastened to the housing 72 in the reverse bore position, such as by one or more shearable fasteners (not shown).

The actuator may include a gas chamber, a hydraulic chamber, an actuation chamber, an atmospheric chamber 79, a first solenoid 75*a*, a first pick 76*a*, a second solenoid 75*b*, a second pick 76*b*, a first rupture disk 77*a*, and a second rupture disk 77*b*, an actuation piston 81, and a piston shoulder 90 of the mandrel 80. The gas, hydraulic, and actuation chambers may each be formed in a wall of the housing 72. An upper balance piston 65*u* may be disposed in the gas chamber and may divide the chamber into an upper portion and a lower portion. A port may provide fluid communication between the gas chamber upper portion and the annulus 48. The lower portion may be filled with an inert gas, such as nitrogen 74. The nitrogen 74 may be compressed to serve as a fluid energy source for the actuator. The gas chamber may be in limited fluid communication with the hydraulic chamber via a choke passage 88. The choke passage 88 may dampen movement of the mandrel 80 to the other positions. A lower balance piston 65*b* may be disposed in the hydraulic chamber and may divide the chamber into an upper portion and a lower portion. The lower portion may be filled with the hydraulic oil 66.

The solenoids 75*a,b* and the picks 76*a,b* may be disposed in the actuation chamber. A hydraulic passage may be formed in a wall of the housing 72 and may provide fluid communication between the hydraulic chamber and the actuation chamber. The atmospheric chamber 79 may be formed radially between the housing and the mandrel 80 and longitudinally between a shoulder 91*a* and a bulkhead 91*b*, each formed in an inner surface of the housing 72. A seal may be disposed in an interface between the shoulder 91*a* and an upper sleeve portion 80*u* of the mandrel 80 and another seal may be disposed in an interface between the bulkhead 91*b* and a mid sleeve portion 80*m* of the mandrel. The actuation piston 81 may be disposed in the atmospheric chamber 79 and may divide the chamber into an upper portion 79*u* and a mid portion 79*m*. The atmospheric chamber 79 may also have a reduced diameter lower portion 79*b* defined by another shoulder 91*c* formed in an inner surface of the housing 72. The mandrel piston shoulder 90 may have an outer diameter corresponding to the reduced diameter of the atmospheric chamber lower portion 79*b* and may carry a seal for engaging therewith. The actuation piston 81 may be trapped between the housing shoulder 91*a* and the mandrel piston shoulder 90 when the mandrel is in the reverse bore position.

A first actuation passage may be in fluid communication with the actuation chamber and the atmospheric chamber upper portion 79*u*. The first rupture disk 77*a* may be disposed in the first actuation passage, thereby closing the passage. A second actuation passage may be in fluid communication with the actuation chamber and the atmospheric chamber lower portion 79*b*. The second rupture disk 77*b* may be disposed in the second actuation passage, thereby closing the passage.

A bypass chamber 89 may be formed radially between the housing and the mandrel 80 and longitudinally between the bulkhead 91*b* and another shoulder 91*d* formed in an inner surface of the housing 72. A seal may be disposed in an interface between the shoulder 91*d* and a lower sleeve portion 80*b* of the mandrel 80. A valve shoulder 82 of the mandrel 80 may be disposed in the bypass chamber 89 and may divide the chamber into an upper portion 89*u* and a lower portion 89*b*. The valve shoulder 82 may have one or more longitudinal passages 82*a* and one or more radial ports 82*p* formed therethrough. Each longitudinal passage 82*a* may provide fluid communication between the bypass chamber upper 89*u* and lower 89*b* portions. The valve shoulder 82 may carry a pair of seals straddling the radial ports 82*r* and engaged with the housing 72, thereby isolating the mandrel bore from the bypass chamber 89.

Figure 5D:
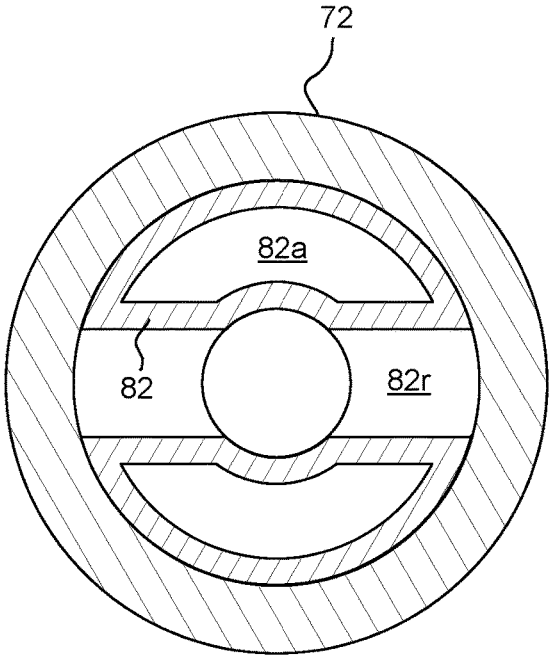
FIGS. 5A-5D illustrate a crossover tool of the LDA.
Figure 5E:
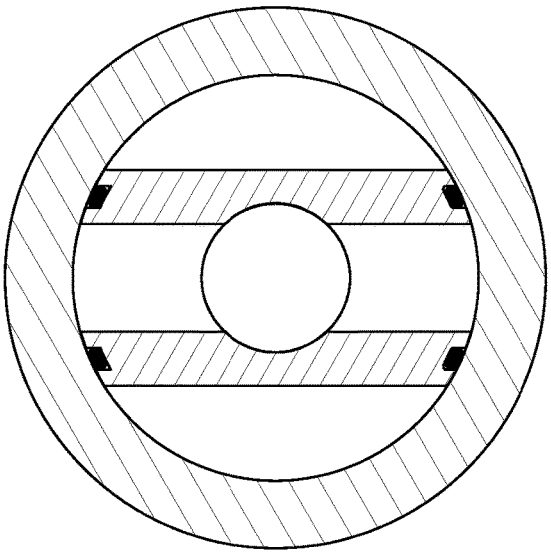
FIG. 5E illustrates an alternative valve shoulder of the crossover tool.

FIG. 5E illustrates an alternative valve shoulder of the crossover tool. Alternatively, the valve shoulder may have a rectangular cross sectional shape having arcuate short sides to form the longitudinal passages between an outer surface thereof and the housing and each radial port may be isolated by a seal molded into a transverse groove formed in an outer surface of the valve shoulder and extending around the respective radial port.

Returning to FIGS. 5A-5D, the rotary seal 85 may be disposed in a gap formed in an outer surface of the housing 72 adjacent to the bypass chamber 89. One or more upper bypass ports 84*u* and one or more mid bypass ports 84*m* may be formed through a wall of the housing 72 and may straddle the rotary seal 85. The rotary seal 85 may include a directional seal, such as a cup seal 85*c*, a gland 85*g*, a sleeve 85*s*, and bearings 85*b*. The seal sleeve 85*s* may be supported from the housing 72 by the bearings 85*b* so that the housing 72 may rotate relative to the seal sleeve. A seal may be disposed in an interface formed between the seal sleeve 85*s* and the housing 72. The gland 85*e* may be connected to the seal sleeve 85*s* and a seal may be disposed in an interface formed therebetween. The cup seal 85*c* may be connected to the gland, such as molding or press fit. An outer diameter of the cup seal 85*c* may correspond to an inner diameter of the casing 25, such as being slightly greater than the casing inner diameter. The cup seal 85*c* may be oriented to sealingly engage the casing 25 in response to annulus pressure below the cup seal being greater than annulus pressure above the cup seal.

The housing 72 may further have a stem 86 extending from a lower shoulder 91*e* of the housing into the mandrel bore, thereby forming a receiver chamber between the housing shoulders 91*d,e*. A seal may be disposed in an interface between an outer surface of the mandrel lower sleeve portion 80*b* and an outer surface of the receiver chamber and spaced from the housing shoulder 91*d* to straddle one or more bypass ports 87 of the mandrel in the forward bore position. The stem 86 may have an upper stringer portion 86*p*, a lower sleeve portion 86*v*, and a shoulder 86*s* formed between the stinger and sleeve portions. A seal may be disposed in an outer surface of the sleeve portion 86*v* adjacent to the shoulder 86*s*. The stem 86 may further have one or more vent ports 86*p* formed through a wall of the sleeve portion 86*v* adjacent to the lower housing shoulder 91*e* and one or more lower bypass ports 84*b* formed through the sleeve portion wall adjacent to the housing shoulder 91*d*. A pair of seals may be disposed in the outer surface of the sleeve portion 86*v* and may straddle the lower bypass ports 84*b*.

The check valve 83 may include a portion of the mandrel 80 forming a body and a valve member, such as a flapper, pivotally connected to the body and biased toward a closed position, such as by a torsion spring. The flapper may be oriented to allow upward fluid flow therethrough and prevent reverse downward flow. The mandrel may further include a shoulder 92 for landing on the stem shoulder 86*s* in the forward bore position, thereby also propping the flapper open by the stinger 86*p*.

Alternatively, the balance piston 65*b* and oil 66 may be omitted and the inert gas 74 used to dampen movement and drive the actuating piston 81 and piston shoulder 90. Alternatively, the balance piston 65*u* and the inert gas 74 may be omitted, the oil 66 used to dampen movement of the actuating piston 81, and hydrostatic head in the annulus used to drive the actuating piston and piston shoulder. Alternatively, the balance piston 65*u* and the inert gas 74 may be omitted and the oil 66 used to dampen movement and drive the actuating piston 81. Alternatively, a fuse plug and heating element may be used to close each actuation passage and the respective passage may be opened by operating the heating element to melt the fuse plug. Alternatively, a solenoid actuated valve may be used to close each actuation passage and the respective passage may be opened by operating the solenoid valve actuator.

Figure 6A:
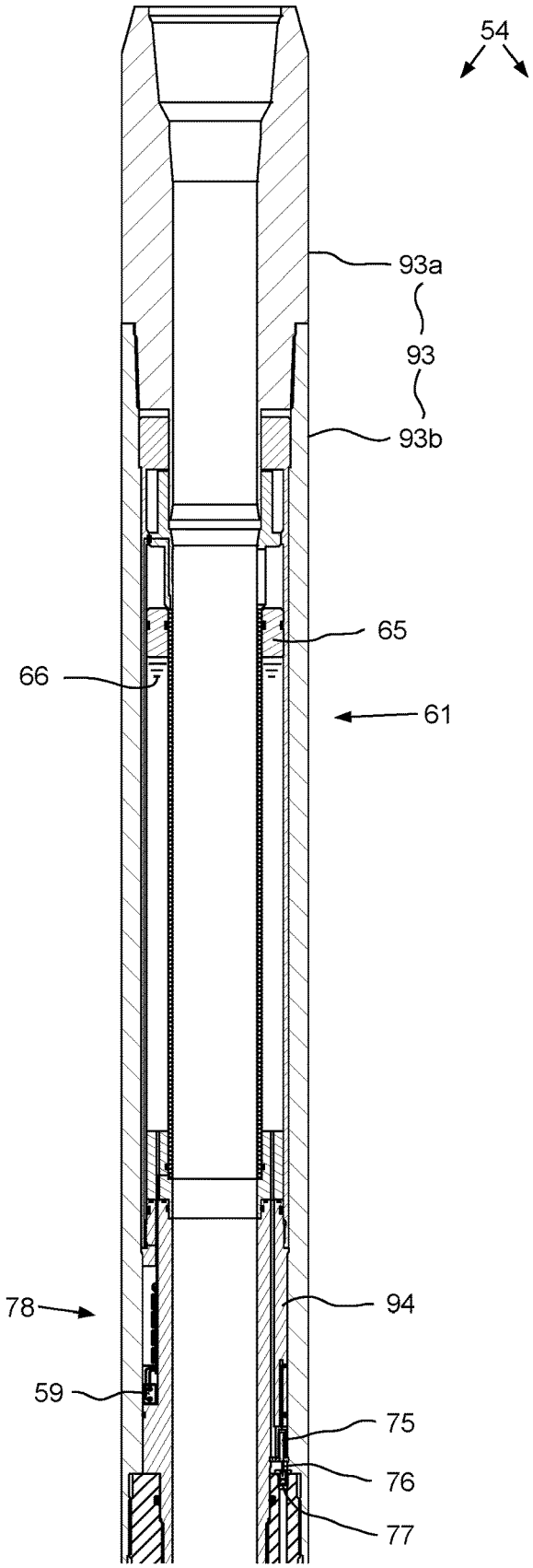
FIGS. 6A and 6B illustrate a liner isolation valve of the LDA.
Figure 6B:
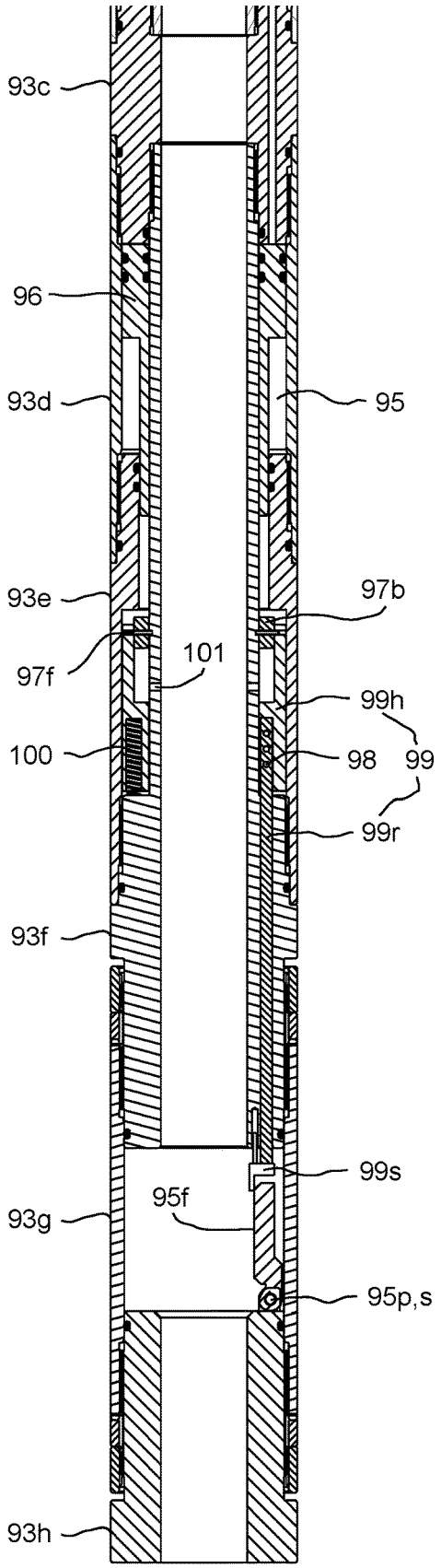

FIGS. 6A and 6B illustrate the liner isolation valve 54. The isolation valve 54 may include a housing 93, the electronics package 78, a power source, such as the battery 59, a mandrel 94, the antenna 61, an actuator, and one or more valve members, such as a flapper 95*f*, flapper pivot 95*p*, and torsion spring 95*s*. The housing 93 may include two or more tubular sections 93*a-h* connected to each other, such as by threaded couplings. The housing 93 may have couplings, such as threaded couplings, formed at each longitudinal end thereof for connection to the latch 55 at an upper end thereof and the stinger 56 at a lower end thereof. The housing 93 may have a pocket formed therein for receiving the antenna 61 and the mandrel 94. The isolation valve 54 may further include seals at various interfaces thereof.

The actuator may include a hydraulic chamber, an actuation recess, an atmospheric chamber 95, the solenoid 75, the pick 76, the rupture disk 77, an actuation piston 96, one or more shearable fasteners 97*f*, a shear block 97*b*, one or more fasteners, such as pins 98, a valve retainer 99 and a biasing member, such as spring 100. The valve retainer 99 may include a head 99*h*, a rod 99*r*, and stop 99*s*.

Alternatively, the actuator may be any of the crossover tool actuator alternatives, discussed above.

The head 99*h* may be fastened to the housing 93*f* by the shearable fasteners 97*f*. The head 99*h* may also be linked to the flapper 95*f* via the retaining rod 99*r* and stop 99*s*. The head 99*h* may be biased away from the flapper 95*f* by the spring 100. The head 99*h* may be connected to the retaining rod 99*r* via the pins 98. The retaining rod 99*r* may hold the flapper 95*f* in the open position via the stop 99*s*. The flapper 95*f* may be biased toward the closed position by the torsion spring 95*s*. The solenoid 75 and pick 76 may be disposed in the actuation recess. The actuation recess may be in fluid communication with the hydraulic reservoir via a hydraulic passage formed through the mandrel. An actuation passage may be formed through the housing section 93*c* to provide fluid communication between the hydraulic reservoir and an upper face of the piston 96 and may be closed by the rupture disk 77. The housing 93 may have a vent 101 formed through a wall of the housing section 93*f* providing fluid communication between a bore of the isolation valve 54 and a release chamber formed between the housing sections 93*e,f*.

In operation (FIG. 10A), once the MCU receives the command signal from the LIV tag 45*c*, the solenoid 75 may be energized, thereby driving the pick 76 into the rupture disk 77. Once the rupture disk 77 has been punched, hydraulic fluid 66 from the reservoir may drive the piston 95 downward into the shear block 97*b*, thereby fracturing the shearable fasteners 97*f* and releasing the head 99*h*. The spring 100 may push the head 99*h* upward away from the flapper 95*f*, thereby also pulling the rod 99*r* and stop 99*s* away from the flapper 95*f*. The torsion spring 95*s* may then close the flapper 95*f*, thereby fluidly isolating the liner string 15 from the expander 53.

FIGS. 7A-7E and 9A-9D illustrate operation of an upper portion of the LDA. FIGS. 8A-8E and 10A-10D illustrate operation of a lower portion of the LDA.

Referring specifically to FIGS. 7A and 8A, during reaming of the liner string 15, the drilling fluid 47*m* may bypass the rotary seal 85 by entering the lower portion 89*b* of the bypass chamber 89 via the upper bypass ports 84*u*, flowing down the lower bypass chamber portion, and exiting the lower bypass chamber portion via the mid bypass ports 84*m*. The returns 47*r* may exit the upper liner joint 15*j* and enter the LDA 9*d* via a bore of the stinger 56 and the propped open float collar valve. The returns 47*r* may continue through the bore of the liner isolation valve 54 having the flapper 95*f* held open and into the crossover tool 51 via the expander 53 and flushing sub 52. The returns 47*r* may continue through the crossover tool 51 in the reverse bore mode via a bore of the stem 86, a bore of the mandrel 80 (including the open check valve 83), and a bore of the housing 72 and into the circulation sub 50. The returns 47*r* may continue through the circulation sub 50 via a bore of the valve sleeve 70, a bore of the piston 60, a bore of the mid housing section 57*m*, a bore of the mandrel 62, a bore of the antenna liner 61*r*, and a bore of the upper housing section 57*u*. The returns 47*r* may then exit the LDA 9*d* and enter the drill pipe 9*p*.

Once the liner string 15 has been reamed into the lower formation 27*b* to a desired depth, the first launcher 43*a* may be operated to launch the first crossover tag 45*a*. The first launcher actuator may then move the plunger to the release position (not shown). The carrier and first crossover tag 45*a* may then move into the return line first segment 40*a*. The drilling fluid 47*m* discharged by the mud pump 34 may then carry the first crossover tag 45*a* from the first launcher 45*a* and through an annulus of the UMPRP 16*u*. The first crossover tag 45*a* may flow from the UMRP annulus, down the riser annulus, and into the wellbore annulus 48 via an annulus of the LMRP 16*b*, BOP stack, and wellhead 10. The first crossover tag 45*a* may continue through the wellbore annulus 48 to the outer antenna 610 of the crossover tool 51. The first crossover tag 45*a* may then communicate the command signal to the outer antenna 61*o*. Rotation 8 of the liner string 15 may continue while shifting the crossover tool.

Referring specifically to FIGS. 7B and 8B, once the crossover MCU receives the command signal from the first crossover tag 45*a*, the crossover MCU may energize the first solenoid 75*a*, thereby driving the first pick 76*a* into the first rupture disk 77*a*. Once the first rupture disk 77*a* has been punched, hydraulic fluid 66 from the reservoir may drive the actuation piston 81 downward toward the housing shoulder 91*c*. The actuation piston 81 may push the mandrel piston shoulder 90 downward into the atmospheric chamber lower portion 79*b*. Once the downward stroke has finished by the actuation piston 81 seating against the housing shoulder 91*c*, the mandrel radial ports 82*r* may be aligned with the mid bypass ports 84*m* and the mandrel bypass ports 87 may be aligned with the lower bypass ports 84*b*. Shifting of the crossover tool 51 from the reverse bore position to the bypass position may be verified by monitoring the pressure gauge 37*m*.

Once the crossover tool 51 has shifted to the bypass position, the fluid handling system 1*h* may be switched to a cementing mode by opening the valves 44*c,f* and closing the valves 44*b,e,g*. The cement pump 13 may then be operated to pump a lead gel plug (not shown) followed by a quantity of heating fluid 102 from the mixer 42 and into the workstring bore via the cement line 14*a,b* and the swivel 7. Once the heating fluid 102 has been pumped, a trail gel plug (not shown) may be pumped from the mixer 42 and into the workstring bore via the via the cement line 14*a,b* and the swivel 7. As the trail gel plug is being pumped, the second tag launcher 43*b* may be operated to launch the first circ tag 45*b* into the trail gel plug.

Once the trail gel plug has been pumped, the fluid handling system 1*h* may be switched to a circulation mode by opening the valves 44*b,d* and closing the valve 44*c*. The mud pump 34 may then be operated to pump drilling fluid 47*m* into the workstring bore via mud line segments 39*a,b* and cement line segment 14*b*, thereby propelling the trail gel plug down the workstring bore. The heating fluid 102 may flow down the workstring bore and through the circulation sub bore to the closed check valve 83. The heating fluid may be diverted by the check valve 83 and into the annulus 48 via the aligned mandrel radial ports 82*r* and mid bypass ports 84*m*. The heating fluid 102 may continue down the annulus 48 until the heating fluid has filled the lower formation 27*b*. Rotation 8 of the liner string 15 may continue while placing the heating fluid 102 into the lower formation 27*b*.

Drilling fluid 47*m* displaced by the heating fluid 102 may flow up the liner bore, exit the an upper liner joint 15*j*, and enter the LDA 9*d* via a bore of the stinger 56 and the propped open float collar valve. The displaced drilling fluid 47*m* may continue through the bore of the liner isolation valve 54 having the flapper 95*f* held open and into the crossover tool 51 via the expander 53 and flushing sub 52. The displaced drilling fluid 47*m* may continue through the crossover tool 51 via a bore of the stem 86 and be diverted into the lower bypass chamber portion 89*b* by the closed check valve 83 via the aligned lower bypass and mandrel bypass ports 84*b*, 87. The displaced drilling fluid 47*m* may continue up the lower bypass chamber portion 89*b* and into the upper bypass chamber portion 89*u* via the longitudinal passages 82*a*. The displaced drilling fluid 47*m* may exit the upper bypass chamber portion 89*u* and flow into an upper portion of the annulus 48 (annulus divided by rotary seal 85) via the upper bypass ports 84*u*. The displaced drilling fluid 47*m* may flow up the annulus upper portion and to the return line 40*a,b* via the wellhead, LMRP, riser, and UMRP annuli. The displaced drilling fluid 47*m* may flow through the open valve 44*f* and to the tank 35 via the return line 40*a,b* and shaker 36.

Referring specifically to FIGS. 7C and 8C, the circulation sub MCU 58*c* may receive the command signal from the first circ tag 45*b* and open the circulation ports 68, thereby bypassing the crossover tool 51, flushing sub 52, expander 53, liner isolation valve 54, and liner string 15 so that the heating fluid 102 may heat the lower formation 27*b* undisturbed. Circulation of drilling fluid 47*m* and rotation 8 of the liner string 15 may continue while heating the lower formation 27*b*.

Referring specifically to FIGS. 7D and 8D, once the lower formation 27*b* has been heated, the fluid handling system 1*h* may be again switched to the cementing mode by opening the valve 44*c* and closing the valves 44*b,d*. The cement pump 13 may then be operated to pump a lead gel plug (not shown) followed by a quantity of spacer fluid 103 from the mixer 42 and into the workstring bore via the cement line 14*a,b* and the swivel 7. The spacer fluid 103 may be an abrasive slurry to scour the lower formation 27*b*. As the lead gel plug is being pumped, the second tag launcher 43*b* may again be operated to launch a second circ tag 45*b* into the lead gel plug. Once the spacer fluid 103 has been pumped, a first intermediate gel plug (not shown) may be pumped from the mixer 42 and into the workstring bore via the via the cement line 14*a,b* and the swivel 7. Once the first intermediate gel plug has been pumped, the cement pump 13 may pump a quantity of cement slurry 104 from the mixer 42 and into the workstring bore via the cement line 14*a,b* and the swivel 7.

Once the cement slurry 104 has been pumped, a second intermediate gel plug (not shown) may be pumped from the mixer 42 and into the workstring bore via the via the cement line 14*a,b* and the swivel 7. Once the second intermediate gel plug has been pumped, the cement pump 13 may pump a quantity of chaser fluid 105 from the mixer 42 and into the workstring bore via the cement line 14*a,b* and the swivel 7. The chaser fluid 105 may have a density less or substantially less than the cement slurry 104 so that the liner string 15 is in compression during curing of the cement slurry. The chaser fluid 130*d* may be the drilling fluid 47*m*. As the chaser fluid 105 is being pumped, a fourth tag launcher (not shown) may be operated to launch a second crossover tag 45*a* into the chaser fluid. Once the chaser fluid 105 has been pumped, the cement pump 13 may pump a trail gel plug 106 from the mixer 42 and into the workstring bore via the cement line 14*a,b* and the swivel 7. As the trail gel plug is being pumped, the third tag launcher 43*c* may be operated to launch the LIV tag 45*c* into the trail gel plug.

Once the trail gel plug has been pumped, the fluid handling system 1*h* may again be switched to a circulation mode by opening the valves 44*b,d* and closing the valve 44*c*. The mud pump 34 may then be operated to pump drilling fluid 47*m* into the workstring bore via the mud line segments 39*a,b* and cement line segment 14*b*, thereby propelling the trail gel plug down the workstring bore. The circulation sub MCU 58*c* may receive the command signal from the second circ tag 45*b* in the lead gel plug and close the circulation ports 68. The spacer fluid may be pumped through the lower formation and the cement slurry pumped into the lower formation 27*b*, as discussed above for the heating fluid 102 and displaced drilling fluid 47*m*. Rotation 8 of the liner string 15 may continue while scouring and placing cement into the lower formation 27*b*.

Referring specifically to FIGS. 7E and 8E, once the crossover MCU receives the command signal from the second crossover tag 45*a* (via the inner antenna 61*i*), the crossover MCU may energize the second solenoid 75*b*, thereby driving the second pick 76*b* into the second rupture disk 77*b*. Once the second rupture disk 77*b* has been punched, hydraulic fluid 66 from the reservoir may drive the mandrel piston shoulder 90 downward toward the bulkhead 91*b*. Once the downward stroke has finished by the mandrel landing shoulder 92 seating against the stem shoulder 86*s*, the mandrel radial ports 82*r* and the mandrel bypass ports 87 may be closed and the check valve 83 may be propped open by the stem stinger 86*p*. Shifting of the crossover tool 51 to the forward bore position may divert flow of the chaser fluid 105 down the stem bore.

Figure 9A:
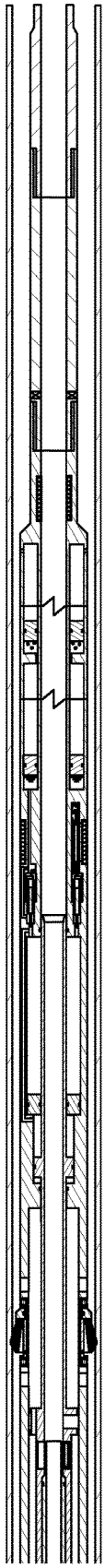
Figures 10A, 10B, 10C, 10D:
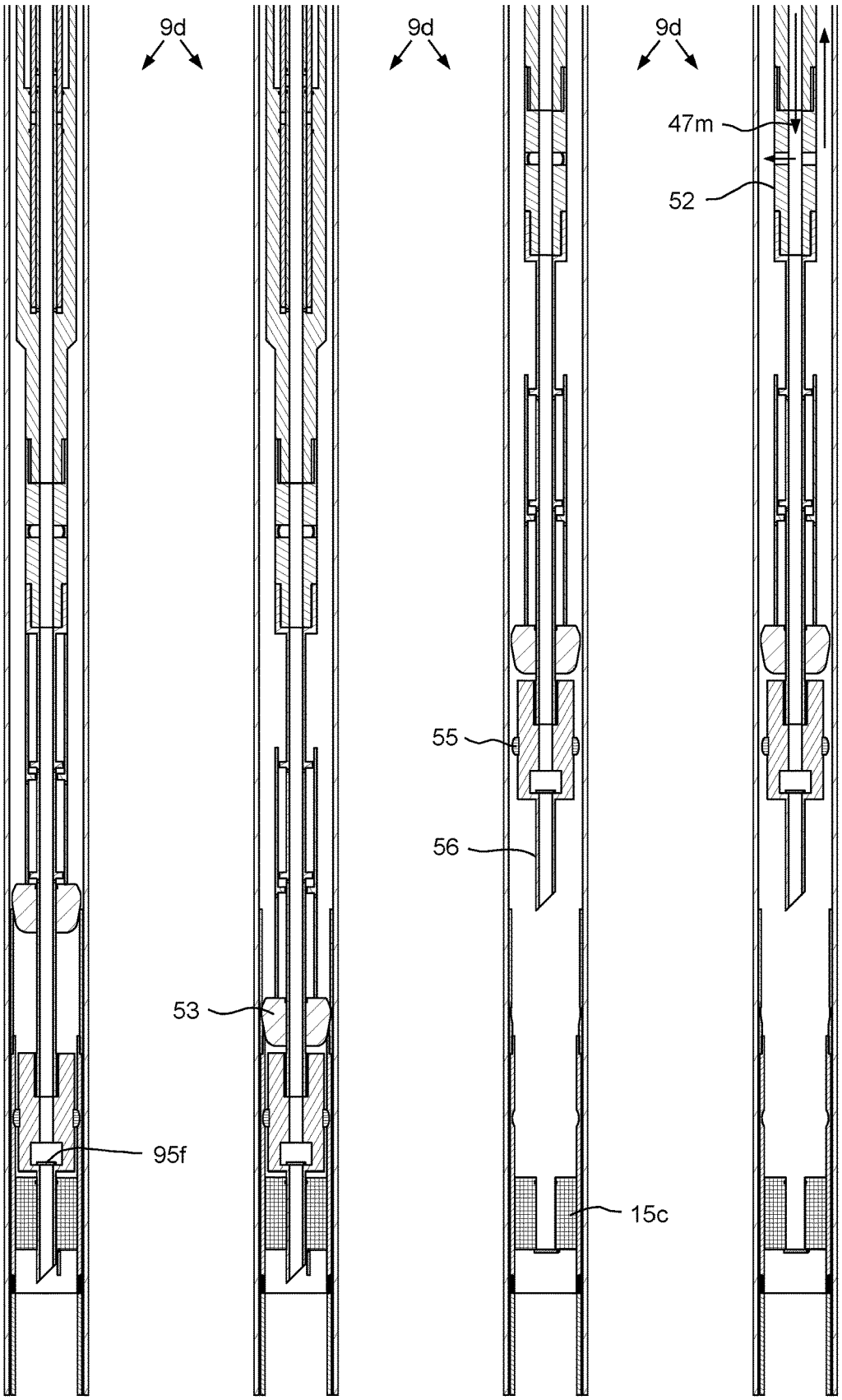

Referring specifically to FIGS. 9A and 10A, once the liner isolation valve MCU receives the command signal from the LIV tag 45*c*, the LIV MCU may energize the solenoid 75, thereby driving the pick 76 into the rupture disk 77 and closing the flapper 95*f*. Closing of the liner isolation valve 54 may be verified by monitoring the pressure gauge 37*m*.

Figure 9B:
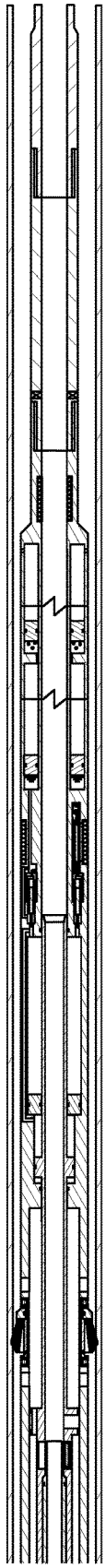

Referring specifically to FIGS. 9B and 10B, once the liner isolation valve 54 has closed, rotation 8 of the liner string 15 may be halted. Pressure may then be increased in the workstring bore to operate the expander piston, thereby driving the expander cone through the expandable liner hanger 15*h*.

Figure 9C:
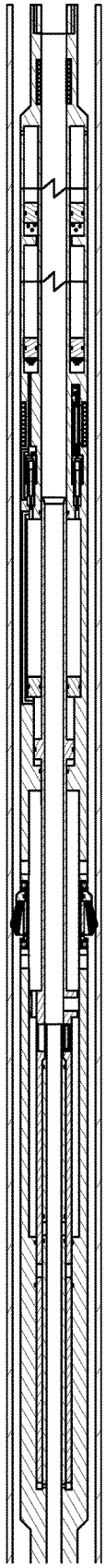

Referring specifically to FIGS. 9C and 10C, once the hanger 15*h* has been expanded into engagement with the casing 25, the latch 55 may be released from the float collar 15*c*, such as by further increasing pressure in the LDA bore and/or rotation of the workstring 9, and the LDA 9*d* disengaged from the liner string 15 by raising the workstring 9, thereby closing the float collar 15*c*.

Figure 9D:
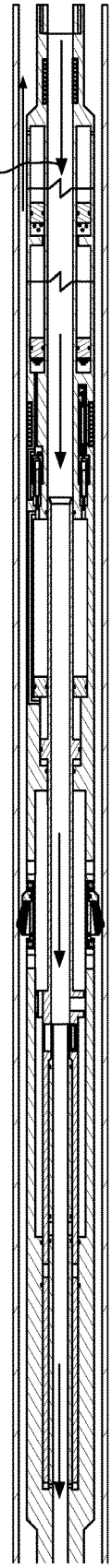

Referring specifically to FIGS. 9D and 10D, once the LDA 9*d* has been disengaged from the liner string 15, pressure in the workstring 9 may further be increased to fracture one or more rupture disks of the flushing sub 52. The workstring 9 may then be flushed as the workstring is being retrieved to the rig 1*r*. A wiper plug (not shown) may also be pumped through the workstring to facilitate flushing.

Alternatively, the first crossover tag may be launched and the crossover tool shifted into the bypass position before reaming and the liner string may be reamed into the lower formation with the fluid handling system in the circulation mode or drilling mode (valve 44*a* open and 44*b* closed).

Alternatively, the mandrel check valve 83 may be replaced with an actuated check valve. This actuated check valve may be similar to the liner isolation valve except that the flapper thereof may be inverted. The actuated mandrel check valve may allow for the liner string to be reamed into the lower formation with the fluid handling system in the circulation mode or drilling mode and for the liner reamer shoe be replaced with a forward circulation reamer shoe. The actuated mandrel check valve may be operated with a fourth RFID tag launched after reaming and before the first crossover tag. Risk of excessive pressure on the lower formation due to the tight clearance may be mitigated by using a managed pressure drilling system having a supply flow meter, a return mass flow meter, a rotating control device, and an automated returns choke, each in communication with a programmable logic controller operable to perform a mass balance and adjust the choke accordingly. The managed pressure drilling system allows a less dense drilling fluid to be used due to employment of the choke which may compensate using backpressure.

Figure 11:
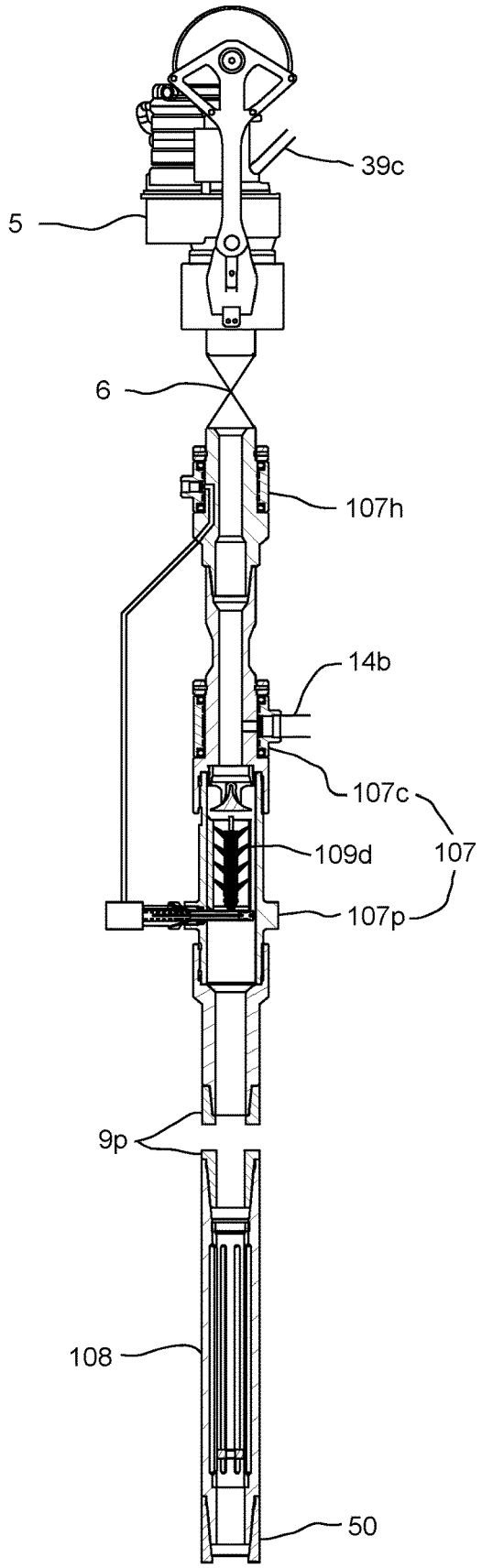
FIG. 11 illustrates an alternative drilling system, according to another embodiment of this disclosure.

FIG. 11 illustrates an alternative drilling system, according to another embodiment of this disclosure. The alternative drilling system may be similar to the drilling system 1 except for replacement of the cementing swivel 7 by a cementing head 107 and addition of a catcher 108 to the LDA. The cementing head 107 may include an actuator swivel 107*h*, a cementing swivel 107*c*, and one or more plug launchers 107*p*. The cementing swivel 107*c* may be similar to the cementing swivel 7. The actuator swivel 51*a* may be similar to the cementing swivel 7 except that the housing inlet may be in fluid communication with a passage formed through the mandrel. The mandrel passage may extend to an outlet of the mandrel for connection to a hydraulic conduit for operating a hydraulic actuator of the launcher 107*p*. The actuator swivel 51*a* may be in fluid communication with a hydraulic power unit (HPU).

Alternatively, the actuator swivel and launcher actuator may be pneumatic or electric.

The launcher 107*p* may include a housing, a diverter, a canister, a latch, and the actuator. The housing may be tubular and may have a bore therethrough and a coupling formed at each longitudinal end thereof, such as threaded couplings. To facilitate assembly, the housing may include two or more sections (three shown) connected together, such as by a threaded connection. The housing may also serve as the cementing swivel housing. The housing may further have a landing shoulder formed in an inner surface thereof. The canister and diverter may each be disposed in the housing bore. The diverter may be connected to the housing, such as by a threaded connection. The canister may be longitudinally movable relative to the housing. The canister may be tubular and have ribs formed along and around an outer surface thereof. Bypass passages may be formed between the ribs. The canister may further have a landing shoulder formed in a lower end thereof corresponding to the housing landing shoulder. The diverter may be operable to deflect fluid received from the cement line 14 away from a bore of the canister and toward the bypass passages. A cementing plug 109*d*, may be disposed in the canister bore. Each launcher 107*p* and respective cementing plug 109*d* may be used in the cementing operation in lieu of a respective gel plug.

The latch may include a body, a plunger, and a shaft. The body may be connected to a lug formed in an outer surface of the launcher housing, such as by a threaded connection. The plunger may be longitudinally movable relative to the body and radially movable relative to the housing between a capture position and a release position. The plunger may be moved between the positions by interaction, such as a jackscrew, with the shaft. The shaft may be longitudinally connected to and rotatable relative to the body. The actuator may be a hydraulic motor operable to rotate the shaft relative to the body.

Alternatively, the actuator may be linear, such as a piston and cylinder. Alternatively, the actuator may be electric or pneumatic. Alternatively, the actuator may be manual, such as a handwheel.

In operation, the HPU may be operated to supply hydraulic fluid to the actuator via the actuator swivel 107*h*. The actuator may then move the plunger to the release position (not shown). The canister and cementing plug 109*d* may then move downward relative to the housing until the landing shoulders engage. Engagement of the landing shoulders may close the canister bypass passages, thereby forcing fluid to flow into the canister bore. The fluid may then propel the cementing plug 109*d* from the canister bore into a lower bore of the housing and onward through the drill pipe 9*p* to the catcher 108.

The catcher 108 may receive one or more plugs 109*d*. The catcher 108 may include a tubular housing, a tubular cage, and a baffle. The housing may have threaded couplings formed at each longitudinal end thereof for connection with other components of the workstring 9, such as the drill pipe 9*p* at an upper end thereof and the circulation sub 50 at a lower end thereof. The housing may have a longitudinal bore formed therethrough for conducting fluid. An inner surface of the housing may have an upper and lower shoulder formed therein.

The cage may be disposed within the housing and connected thereto, such as by being disposed between the lower housing shoulder and a fastener, such as a ring, connected to the housing, such as by a threaded connection. The cage may be made from an erosion resistant material, such as a tool steel or cermet, or be made from a metal or alloy and treated, such as a case hardened, to resist erosion. The retainer ring may engage the upper housing shoulder. The cage may have solid top and bottom and a perforated body, such as slotted. The slots may be formed through a wall of the body and spaced therearound. A length of the slots may correspond to a capacity of the catcher. The baffle may be fastened to the body, such as by one or more fasteners (not shown). An annulus may be formed between the body and the housing. The annulus may serve as a fluid bypass for the flow of fluid through the catcher. The first caught plug 109*d* may land on the baffle. Fluid may enter the annulus from the housing bore through the slots, flow around the caught plugs along the annulus, and re-enter the housing bore thorough the slots below the baffle.

Figure 12:
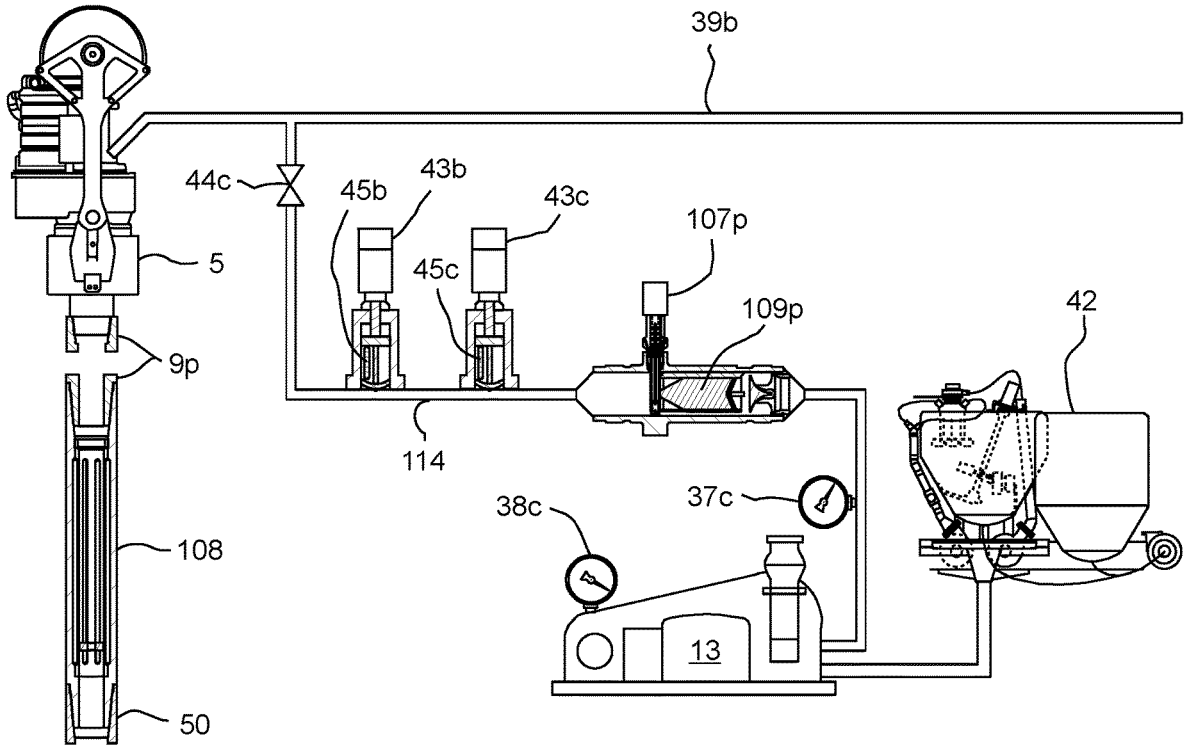
FIG. 12 illustrates another alternative drilling system, according to another embodiment of this disclosure.
Figures 13A, 13B, 13C, 13D:
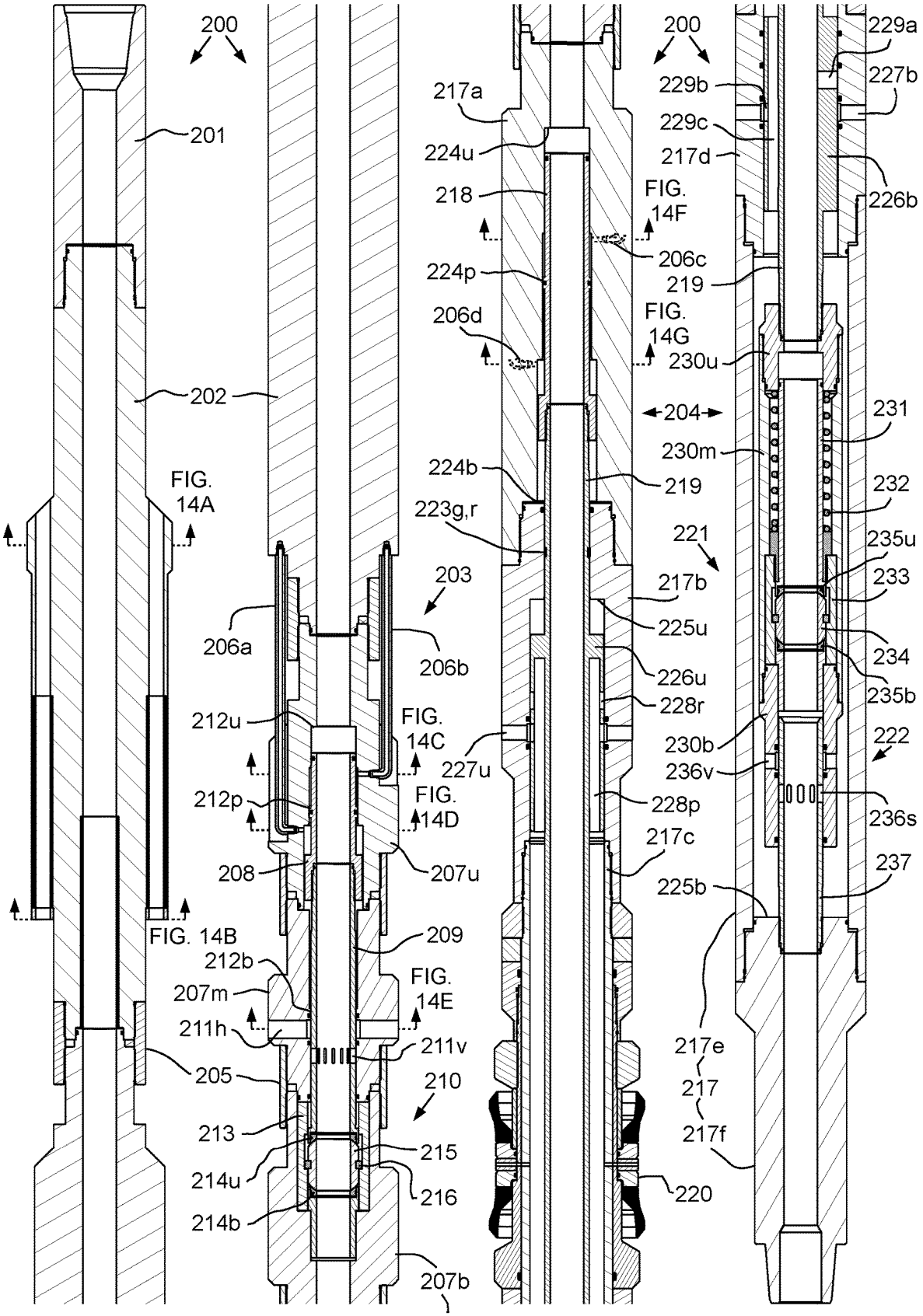
FIGS. 13A-13D illustrate an alternative combined circulation sub and crossover tool for use with the LDA, according to another embodiment of this disclosure.
Figure 14A:
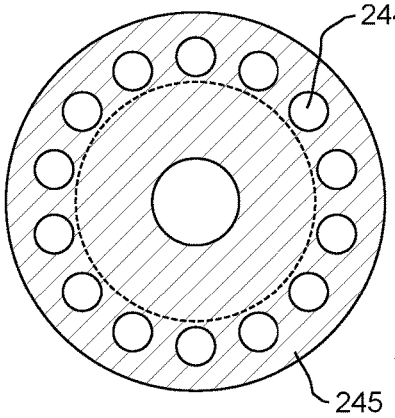
FIGS. 14A-14G illustrate various features of the combined circulation sub and crossover tool.
Figure 14B:
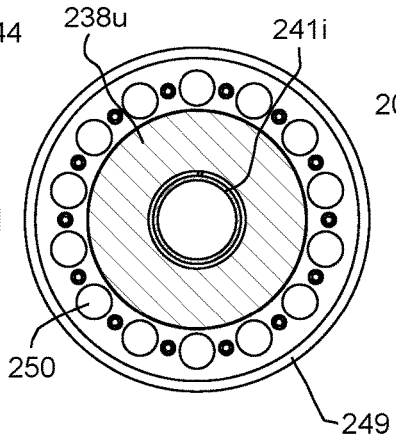
Figure 14C:
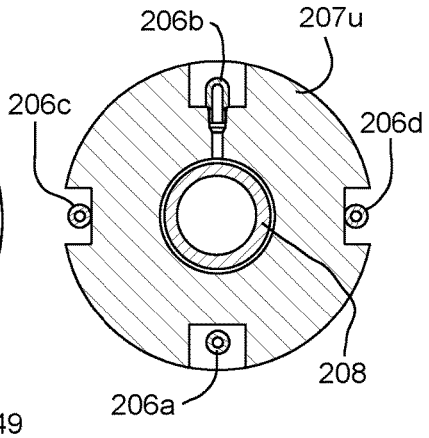
Figure 14D:
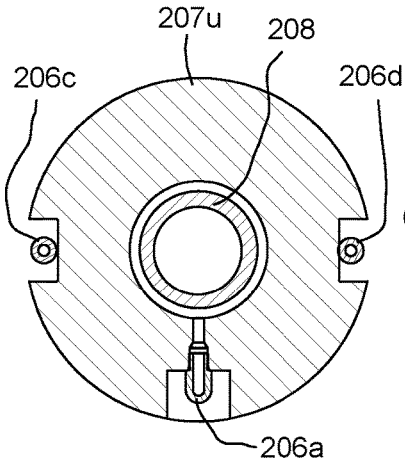
Figure 14E:
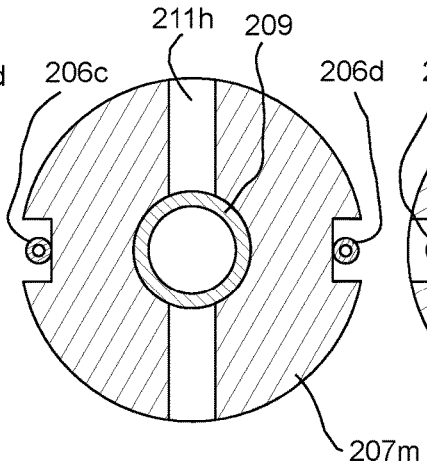
Figure 14F:
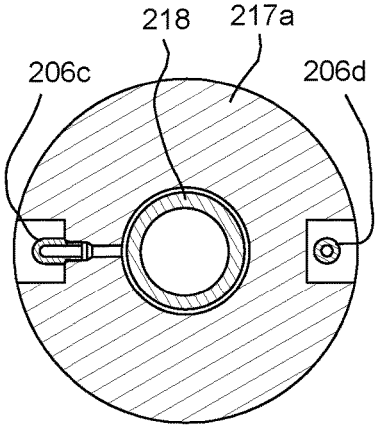
Figure 14G:
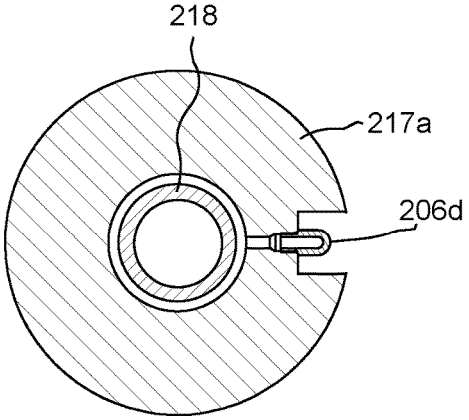

FIG. 12 illustrates another alternative drilling system, according to another embodiment of this disclosure. The alternative drilling system may be similar to the drilling system 1 except for omission of the cementing swivel 7 and second cement line segment 14*b*, addition of one or more of the plug launchers 107*p*, each having a pipeline pig 109*p*, and addition of the catcher 108 to the LDA. The pig 109*p* may include a body, a tail plate. The body may be made from a flexible material, such as a foamed polymer. The foamed polymer may be polyurethane. The body 205 may be bullet-shaped and include a nose portion, a tail portion and a cylindrical portion. The tail portion may be concave or flat. The nose portion may be conical, hemispherical or hemi-ellipsoidal. The tail plate may be bonded to the tail portion during molding of the body. The shape of the tail plate may correspond to the tail portion. The tail plate may be made from a (non-foamed) polymer, such as polyurethane.

Each launcher 107*p* and respective pig 109*p* may be used in the cementing operation in lieu of a respective gel plug. The launcher may be assembled as part of cement line 114 and the cement slurry 104 and associated fluids may be pumped into the workstring through the top drive 5. The pig 109*p* may be flexible enough to be pumped through the top drive 5, down the workstring 9*p* and to the catcher 108.

FIGS. 13A-13D illustrate an alternative combined circulation sub and crossover tool 200 for use with the LDA 9*d*, according to another embodiment of this disclosure. FIGS. 14A-14G illustrate various features of the combined circulation sub and crossover tool 200. The combined circulation sub and crossover tool 200 may be assembled as part of the LDA 9*d* instead of the circulation sub 50 and crossover tool 51, thereby forming an alternative LDA. An upper end of the combined circulation sub and crossover tool 200 may be connected to a lower end of the drill pipe 9*p*, such as by threaded couplings, and a lower end of the combined circulation sub and crossover tool may be connected to an upper end of the flushing sub 52, such as by threaded couplings.

The combined circulation sub and crossover tool 200 may include an adapter 201, a control module 202, a circulation sub 203, and a crossover tool 204. The adapter 201 may be connected to the control module 202, such as by threaded couplings. The control module 202, circulation sub 203, and crossover tool 204 may be connected to each other longitudinally, such as by a threaded nut 205 and threaded couplings, and torsionally, such as by castellations. The control module 202 may be in fluid communication with the circulation sub 203, such as by one or more (pair shown) first hydraulic conduits 206*a,b*. The control module 202 may also be in fluid communication with the crossover tool 204, such as by one or more (pair shown) second hydraulic conduits 206*c,d*.

The circulation sub 203 may include a housing 207, a piston 208, a valve sleeve 209, and a bore valve 210. The housing 207 may include two or more tubular sections, such as an upper section 207*u*, mid section 207*m*, and lower section 207*b*, connected together longitudinally, such as by a threaded nut 205 and threaded couplings, and torsionally, such as by castellations. The housing 207 may also have channels formed in an outer surface thereof for passage of the hydraulic conduits 206*a-d*.

Figure 16A:
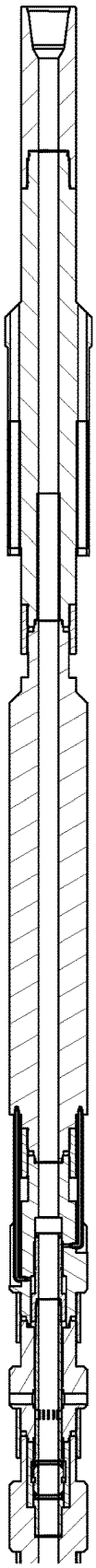
FIGS. 16A-16D illustrate operation of an upper portion of the combined circulation sub and crossover tool.
Figure 16B:
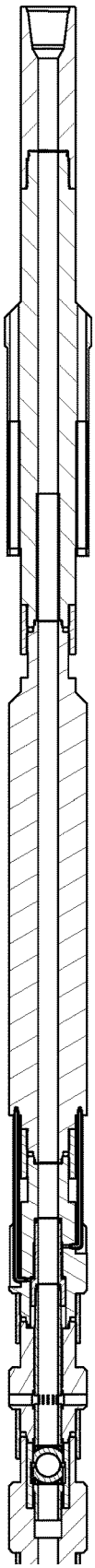
Figure 16C:
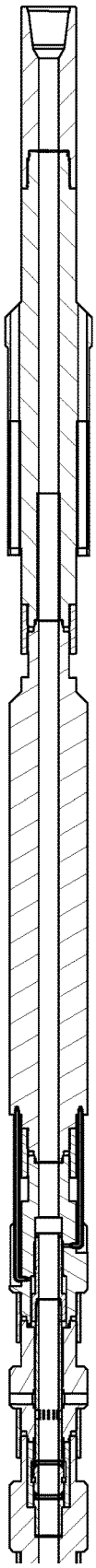
Figure 16D:
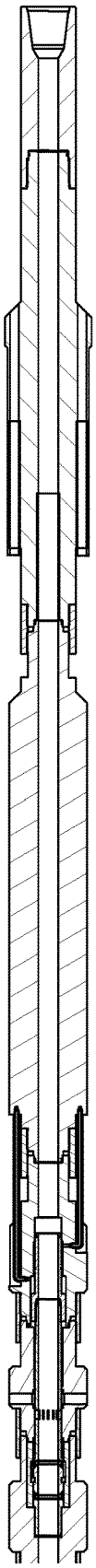

The circulation sub piston 208 may be disposed in the housing 207 and longitudinally movable relative thereto between an upper position (FIG. 16B) and a lower position (shown). The piston 208 may be stopped in the lower position by the bore valve 210. The mid housing section 207*m* may have one or more circulation ports 211*h* formed through a wall thereof. A pair of seals may be disposed in an inner surface of the mid housing section 207*m* and may straddle the circulation ports 211*h*.

The circulation sub valve sleeve 209 may be connected to a lower end of the piston 208, such as by threaded couplings. A seal may be disposed in the interface between the valve sleeve 209 and the piston 208. The valve sleeve 209 may have one or more ports 211*v* formed through a wall thereof corresponding to the circulation ports 211*h*. The valve sleeve 209 may cover the circulation ports 211*h* when the piston 208 is in the lower position, thereby closing the circulation ports, and the valve sleeve ports 211*v* may be aligned with the circulation ports when the piston is in the upper position, thereby opening the circulation ports.

An actuation chamber may be formed between the piston 208 and the housing 207. A shoulder 212*p* formed in an outer surface of the piston may be disposed in the actuation chamber and carry a seal in engagement with an inner surface of the upper housing section 207*u*. The piston shoulder 212*p* may divide the actuation chamber into an opener portion and a closer portion. A shoulder 212*u* formed in an inner surface of the upper housing section 207*u* may serve as an upper end of the actuation chamber. A shoulder 212*b* formed in an inner surface of the mid housing section 207*m* adjacent to the circulation ports 211*h* may serve as a lower end of the actuation chamber. Each portion of the actuation chamber may be in fluid communication with a respective hydraulic conduit 206*a,b* via a respective hydraulic passage formed in a wall of the upper housing section 207*u*.

The bore valve 210 may be operable between an open position (shown) and a closed position (FIG. 16B) by interaction with the valve sleeve 209. In the open position, the bore valve 210 may allow flow through the circulation sub 203 to the crossover tool 204. In the closed position, the bore valve 210 may close the circulation sub bore below the circulation ports 211*h*, thereby preventing flow to the crossover tool 204 and diverting all flow through the ports. The bore valve 210 may be operably coupled to the valve sleeve 209 such that the bore valve is open when the circulation ports 211*h* are closed and the bore valve is closed when the circulation ports are open.

The bore valve 210 may include a cam 213, upper 214*u* and lower 214*b* seats, and a valve member, such as a ball 215. The cam 213 may be connected to the housing 207 by being disposed within a recess formed between the mid 207*m* and lower 207*b* housing sections. Each seat 214*u,b* may be disposed between the valve sleeve 209 and the ball 215 and biased into engagement with the ball by a respective spring disposed between the respective seat and the valve sleeve. The ball 215 may be longitudinally connected to the valve sleeve 209 by being trapped in openings formed through a wall thereof. The ball 215 may be disposed within the cam 213 and may be rotatable relative thereto between an open position and a closed position by interaction with the cam. The ball 215 may have a bore therethrough corresponding to the piston/sleeve bore and aligned therewith in the open position. A wall of the ball 215 may isolate the crossover tool 204 from the circulation sub 203 in the closed position. The cam 213 may interact with the ball 215 by having a cam profile, such as slots, formed in an inner surface thereof. The ball 215 may carry corresponding followers 216 in an outer surface thereof and engaged with respective cam profiles or vice versa. The ball-cam interaction may rotate the ball 215 between the open and closed positions in response to longitudinal movement of the ball relative to the cam 213.

The crossover tool 204 may include a housing 217, a piston 218, a mandrel 219, a rotary seal 220, a bore valve 221, and a stem valve 222. The housing 217 may include two or more tubular sections 217*a-f* connected to each other, such as by threaded couplings. The housing 217 may have a coupling, such as a threaded coupling, formed at a lower longitudinal end thereof for connection to the flushing sub 52. An upper housing 217*a* section may also have channels formed in an outer surface thereof for passage of the hydraulic conduits 206*c,d*.

Figure 17A:
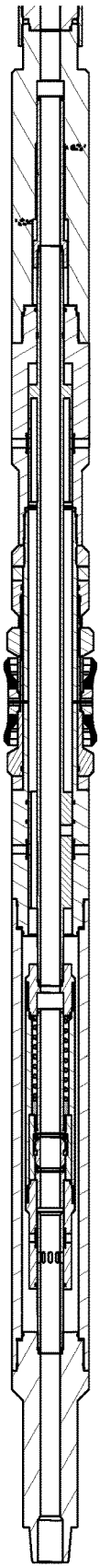
FIGS. 17A-17D illustrate operation of a lower portion of the combined circulation sub and crossover tool.
Figure 17B:
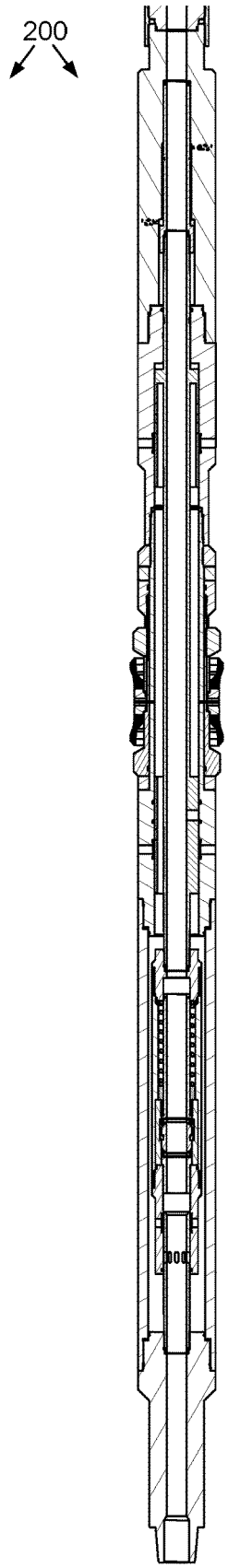
Figure 17C:
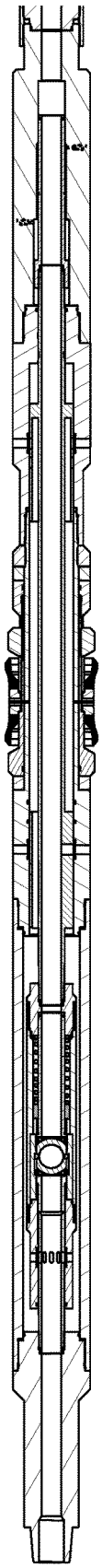
Figure 17D:
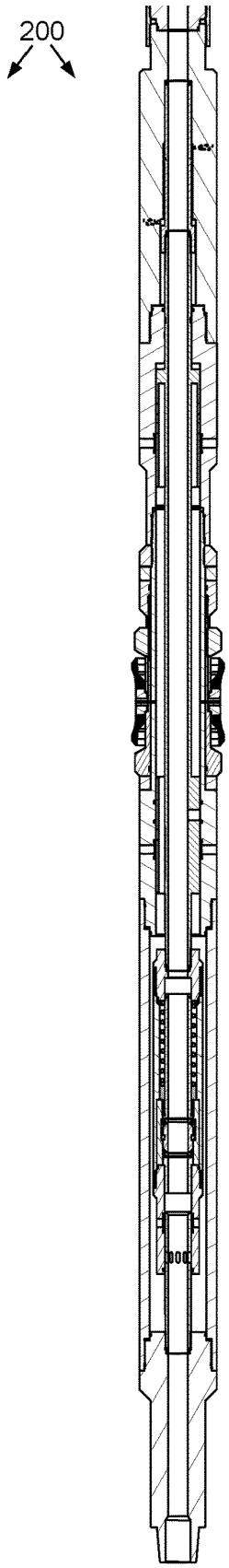

The piston 218 and mandrel 219 may each be tubular and have a longitudinal bore formed therethrough. The piston 218 and mandrel 219 may be connected together, such as by threaded couplings. The piston 218 and mandrel 219 may each be disposed in the housing 217 and longitudinally movable relative thereto among: a reverse bore position (shown and FIG. 17A), a forward bore position (FIGS. 17B and 17D), and a bypass position (FIG. 17C). The mandrel 219 may be fastened to the housing 217 in the reverse bore position, such as by a detent 223*g,r*. The detent 223*g,r* may include a split ring 223*r* carried by the mandrel 219 for engagement with a groove 223*g* formed in the inner surface of a second housing section 217*b*.

An actuation chamber may be formed between the piston 218 and the housing 217. A shoulder 224*p* formed in an outer surface of the piston 218 may be disposed in the actuation chamber and carry a seal in engagement with an inner surface of the upper housing section 217*a*. The piston shoulder 224*p* may divide the actuation chamber into a pusher portion and a puller portion. A shoulder 224*u* formed in an inner surface of the upper housing section 217*a* may serve as an upper end of the actuation chamber. An upper end of the second housing section 217*b* may serve as a lower end 224*b* of the actuation chamber. Each portion of the actuation chamber may be in fluid communication with a respective hydraulic conduit 206*c,d* via a respective hydraulic passage formed in a wall of the upper housing section 207*a*.

A bypass chamber may be formed radially between the housing 217 and the mandrel 219 (and bore valve 221) and longitudinally between a shoulder 225*u* formed in an inner surface of the second housing section 217*b* and an upper end 225*b* of a lower housing section 217*f*. The mandrel 219 may have upper 226*u* and lower 226*b* valve shoulders straddling the rotary seal 220, each valve shoulder disposed in the bypass chamber. The second 217*b* and fourth 217*d* housing sections may have one or more respective upper 227*u* and lower 227*b* bypass ports formed through a wall thereof. The upper valve shoulder 226*u* may have a pair of one or more radial passage ports 228*r* and a longitudinal passage 228*p* in communication therewith. The upper valve shoulder radial ports 228*r* may be aligned with the upper bypass ports 227*u* in the reverse bore and bypass positions and a wall of the upper valve shoulder 226*u* may close the upper bypass ports in the forward bore position.

The lower valve shoulder 226*b* may have one or more radial bore ports 229*a* formed through a wall of the mandrel 219. The lower valve shoulder 226*b* may also have one or more radial passage ports 229*b* and a longitudinal passage 229*c* formed therethrough and in communication with the radial passage ports. The lower valve shoulder radial passage ports 229*b* may be aligned with the lower bypass ports 227*b* in the reverse bore position. The lower valve shoulder radial bore ports 229*a* may be aligned with the lower bypass ports 227*b* in the bypass position. A wall of the lower valve shoulder 226*b* may close the lower bypass ports 227*b* in the forward bore position.

The rotary seal 220 may be similar to the rotary seal 85 except for the inclusion of a second cup seal to add bidirectional capability for protecting the lower formation 27*b* during circulation while heating.

The bore valve 221 may include an outer body 230*u,m,b*, an inner sleeve 231, a biasing member, such as a compression spring 232, a cam 233, a valve member, such as a ball 234, and upper 235*u* and lower 235*b* seats. The sleeve 231 may be disposed between in the body 230*u,m,b* and longitudinally movable relative thereto. The body 230*u,m,b* may be connected to a lower end of the mandrel 219, such as by threaded couplings, and have two or more sections, such as an upper section 230*u*, a mid section 230*m*, and a lower section 230*b*, each connected together, such as by threaded couplings. The spring 232 may be disposed in a chamber formed between the sleeve 231 and the mid body section 230*m*. An upper end of the spring 232 may bear against a lower end of the upper body section 230*u* and a lower end of the spring may bear against a spring washer. The ball 234 and ball seats 235*u,b* may be longitudinally connected to the inner sleeve 231 and a lower end of the spring washer may bear against a shoulder formed in an outer surface of the sleeve. A lower portion of the inner sleeve 231 may extend into a bore of the lower body section 230*b*. The cam 233 may be trapped in a recess formed between a shoulder of the mid body section 230*m* and an upper end of the lower body section 230*b*. The cam 233 may interact with the ball 234 by having a cam profile, such as slots, formed in an inner surface thereof. The ball 234 may carry corresponding followers in an outer surface thereof and engaged with respective cam profiles or vice versa.

The lower body section 230*b* may also serve as a valve member for the stem valve 222 by having one or more radial ports 236*v* formed through a wall thereof. A stem 237 may be connected to an upper end of the lower housing section 217*f*, such as by threaded couplings, and have one or more radial ports 236*s* formed through a wall thereof. In the reverse bore position, a wall of the lower body section 217*f* may close the stem ports 236*s* and the ball 234 may be in the open position. Movement of the piston 218 and mandrel 219 from the reverse bore to the forward bore position may not affect the positions of the stem valve 222 and bore valve 221. Movement of the piston 218 and mandrel 219 from the reverse bore position to the bypass position may cause an upper end of the stem 237 to engage a lower end of the inner sleeve 231, thereby halting longitudinal movement of the inner sleeve, ball 234, and spring washer relative to the body 230*u,m,b*. As the body 230*u,m,b* continues to travel downward, the relative longitudinal movement of the cam 233 relative to the ball 234 may close the ball and align the body ports 236*v* with the stem ports 236*s*, thereby opening the stem valve 222. The spring 232 may open the ball 234 during movement back to the reverse bore position.

Figures 15A, 15B, 15C:
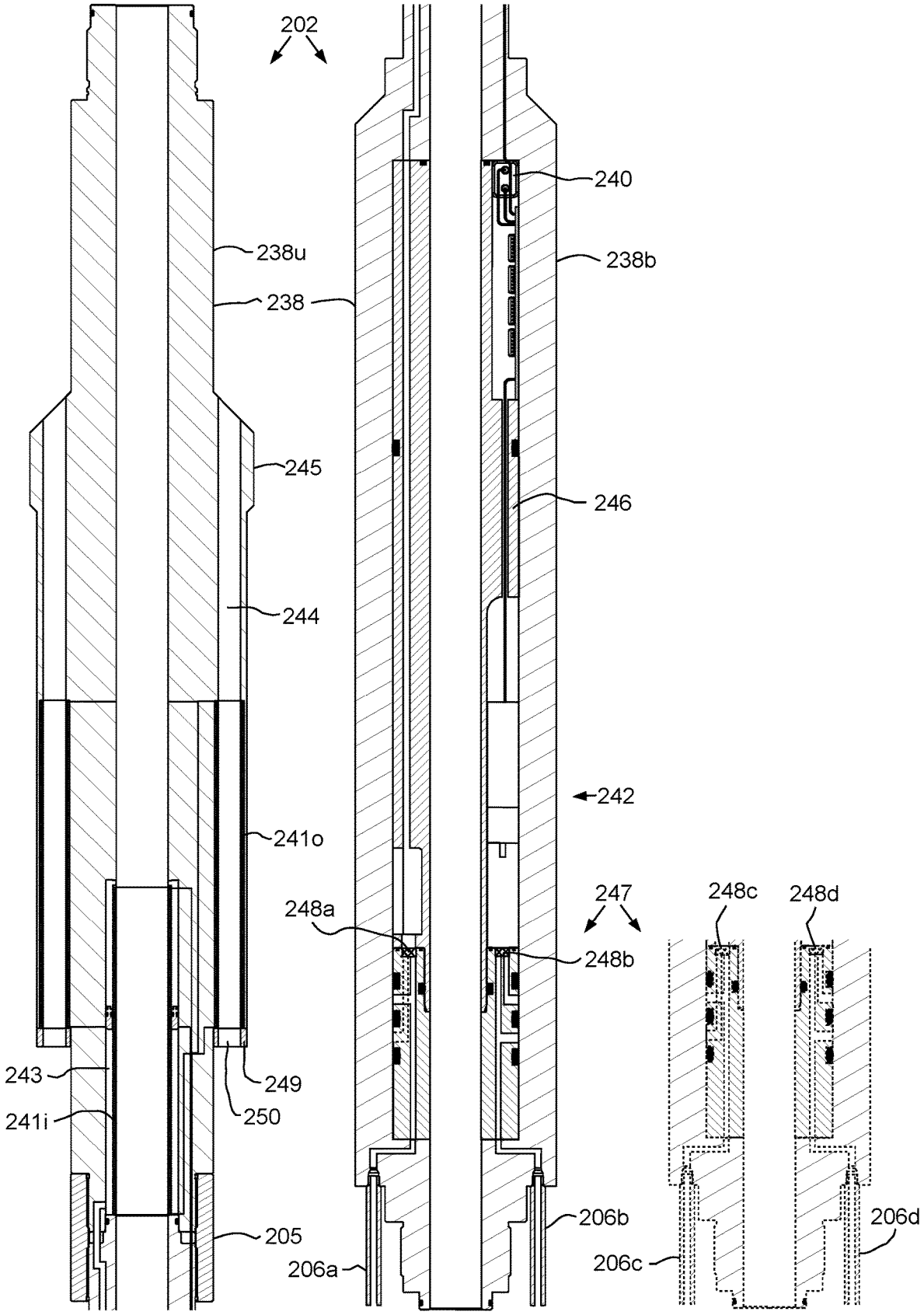
FIGS. 15A-15C illustrate a control module of the combined circulation sub and crossover tool.

FIGS. 15A-15C illustrate the control module 202. The control module 202 may include a housing 238, an electronics package 239, a power source, such as a battery 240, one or more antennas, such as an inner antenna 241*i* and one or more outer antennas 241*o*, and an actuator 242. The housing 238 may include an upper antenna section 238*u* and a lower actuator section 238*b* connected together longitudinally, such as by a threaded nut 205 and threaded couplings, and torsionally, such as by castellations.

The antenna housing section 238*u* may have a pocket 243 formed in an inner surface thereof for receiving the inner antenna 241*i* and forming a reservoir chamber therebetween, similar to that of the circulation sub 50. Each antenna 241*i,o* may also be similar to the circulation sub antenna 61. A mid portion of the antenna housing section 238*u* may have an enlarged outer diameter having longitudinal passages 244 formed therethrough at a periphery thereof. The longitudinal passages 244 may be spaced around the periphery at regular intervals. The antenna housing mid portion may have a slightly enlarged head 245 having an outer diameter corresponding to the inner diameter of the casing 25, such as equal to a drift diameter thereof, and a conical upper end to divert flow from the annulus 48 into the longitudinal passages 244 thereof. The antenna housing section mid portion may have a recess formed in a surface thereof adjacent to each longitudinal passage 244. An outer antenna 2410 may be disposed in each recess to be in electromagnetic communication with an RFID tag 45 pumped down the annulus 48. Each outer antenna 2410 may extend from a base plate 249 fastened to a lower end of the antenna housing section mid portion. The base plate may have passages 250 formed therethrough corresponding to the passages 244 of the antenna housing mid portion.

Alternatively, inner antennas may be disposed in only some of the longitudinal passages, such as every other passage.

The actuator housing section 238*b* may have a pocket formed in an inner surface thereof for receiving the mandrel 246 and a manifold 247. The mandrel 246 may be similar to the circulation sub mandrel 62 and have recesses for receiving the electronics package 239 and the battery 240. The electronics package 239 may be similar to the circulation sub electronics package 58. Lead wires may extend between the antenna housing section 238*u* and the actuator housing section 238*b* for connection of the electronics package 239 and the antennas 241*i,o*. The actuator 242 may be similar to the circulation sub actuator 63 except for inclusion of the manifold 247 instead of just a pair of the control valves 67*u,b*, associated hydraulic passages, and pressure sensors. A hydraulic conduit may extend between the antenna housing section 238*u* and the actuator housing section 238*b* for fluid communication between the actuator and the hydraulic reservoir. The manifold 247 may include a pair of control valves 248*a-d*, associated hydraulic passages, and pressure sensors for each pair of hydraulic conduits 206*a-d*, thereby facilitating independent operation of the circulation sub 203 and crossover tool 204 by the MCU in response to the appropriate command signal from one of the RFID tags 45.

The control module 202 may also provide the capability of repeat actuation of the crossover tool 204, as compared to the single sequential actuation of the crossover tool 51.

Alternatively, the control module may include an actuator for each of the circulation sub and crossover tool. Alternatively, each of the circulation sub and crossover tool may have its own control module.

FIGS. 16A-16D illustrate operation of an upper portion of the combined circulation sub and crossover tool 200. FIGS. 17A-17D illustrate operation of a lower portion of the combined circulation sub and crossover tool 200. The combined circulation sub and crossover tool may be used in a similar liner reaming and cementing operation, as discussed above with reference to FIGS. 7A-10D. For reverse reaming of the liner string, the combined circulation sub and crossover tool 200 may be in a first position, illustrated in FIGS. 16A and 17A, with the circulation sub having the bore valve open and circulation ports closed and the crossover tool in the reverse bore position. For placement of the heating fluid, the combined circulation sub and crossover tool 200 may be left in the first position, the drilling system may be left in the reverse reaming mode and the mud pump used to pump the heating fluid into the lower formation.

A first combined RFID tag may be launched after the heating fluid is pumped and the first tag may be received by the outer antennas. The MCU may receive the command signal from the first tag and shift the combined circulation sub and crossover tool 200 to a second position illustrated in FIGS. 16B and 17B, with the circulation sub having the bore valve closed and circulation ports open and the crossover tool in the forward bore position. Once the first tag reaches the outer antennas, the fluid handling system may be shifted into the circulation mode and circulation may be continued while the heating fluid heats the lower formation.

Once the lower formation has been heated, the fluid handling system may be shifted to the cementing mode and a second combined RFID tag launched into the lead gel plug. A third combined RFID tag may then be launched into the chaser fluid and the LIV tag then launched into the trail gel plug. The fluid handling system may again be switched into the circulation mode. The MCU may then receive the second combined RFID tag and shift the combined circulation sub and crossover tool 200 to a third position illustrated in FIGS. 16C and 17C, with the circulation sub having the bore valve open and circulation ports closed and the crossover tool in the bypass position. Once the cement slurry has been pumped into the lower formation, the MCU may receive the third combined tag and shift the combined circulation sub and crossover tool 200 to a fourth position illustrated in FIGS. 16D and 17D, with the circulation sub having the bore valve open and circulation ports closed and the crossover tool again in the forward bore position. The liner isolation valve may receive the LIV tag and setting of the liner hanger may proceed.

Alternatively, the combined circulation sub and crossover tool 200 may be used in a bullheading operation, especially in the fourth position.

Alternatively, the lower formation 27*b* may not require heating prior to cementing and the circulation sub may be omitted from either LDA 9*d*, 200.

Alternatively, either LDA may include a telemetry sub having an electronics package, one or more antennas, and a power source, such as the battery, for receiving the command signals from the RFID tags. The telemetry sub may be located between the drill pipe and the circulation sub. The telemetry sub may then relay the command signals to the various LDA components via short-hop telemetry. The short-hop telemetry may be wireless, such as electromagnetic telemetry, or utilize inner and outer members of the LDA as conductors, such as transverse electromagnetic telemetry. For example, the telemetry sub could synchronize shifting of the crossover tool to the forward bore position with closing of the liner isolation valve.

Figure 18A:
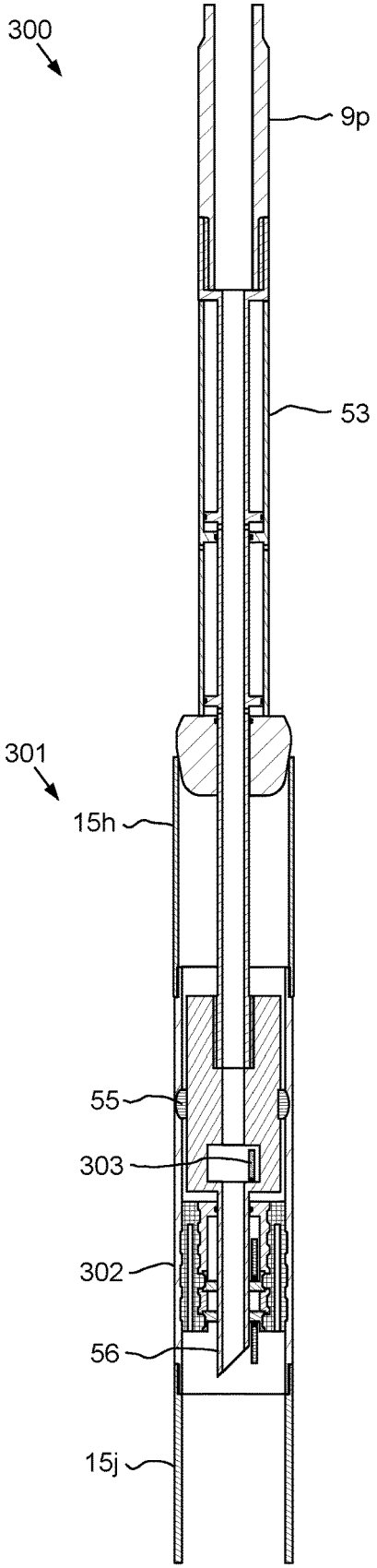
FIG. 18A illustrates an alternative LDA and a portion of an alternative liner string for use with the drilling system, according to another embodiment of this disclosure.
Figure 18B:
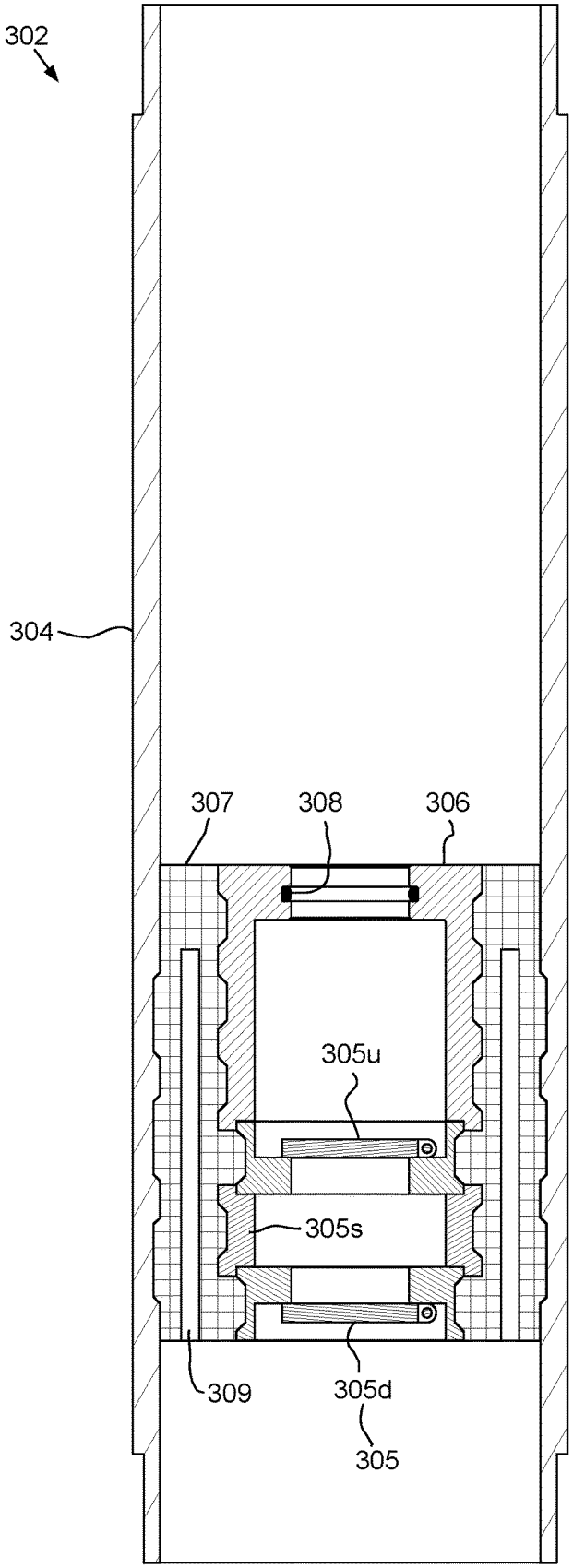
FIG. 18B illustrates a float collar of the alternative liner string.

FIG. 18A illustrates an alternative LDA 300 and a portion of an alternative liner string 301 for use with the drilling system 1, according to another embodiment of this disclosure. FIG. 18B illustrates a float collar 302 of the alternative liner string 301. The alternative liner string 301 may include the liner hanger 15*h*, a float collar 302, joints of liner 15*j*, and a guide shoe 329. The alternative liner string members may each be connected together, such as by threaded couplings.

The float collar 302 may include a tubular housing 304 a shutoff valve 305, and a receptacle 306. The housing 304 may be tubular, have a bore formed therethrough, and have a profile (not shown) for receiving the latch 55. Each of the shutoff valve 305 and receptacle 306 may be disposed in the housing bore and connected to the housing 304 by bonding with a drillable material, such as cement 307. Each of the shutoff valve 305 and receptacle 306 may be made from a drillable material, such as a metal, alloy, or polymer. The shutoff valve 305 may include a pair of oppositely oriented check valves, such as an upward opening flapper valve 305*u* and a downward opening flapper valve 305*d*, arranged in series. Each flapper valve 305*u,d* may include a body and a flapper pivotally connected to the body and biased toward a closed position, such as by a torsion spring (not shown). The flapper valves 305*u,d* may be separated by a spacer 305*s* and the opposed arrangement of the unidirectional flapper valves may provide bidirectional capability to the shutoff valve 305. The flapper valves 305*u,d* may each be propped open by the stinger 56 and the receptacle 306 may have a shoulder carrying a seal 308 for engaging an outer surface of the stinger, thereby isolating an interface between the alternative LDA 300 and the alternative liner string 301. Once the stinger 56 is removed (FIG. 20E), the flappers may close to isolate a bore of the alternative liner string 301 from an upper portion of the wellbore 24.

The float collar 302 may further include one or more (pair shown) bleed passages 309 formed in the cement bond 307. Each bleed passage 309 may extend from a bottom of the cement bond 307 and along a substantial length thereof so as to be above the shutoff valve 305. Each bleed passage 309 may terminate before piercing an upper portion of the cement bond 307, thereby being closed during deployment and setting of the alternative liner string 301. The bleed passages 309 may be opened during drill out of the float collar 302 (FIG. 20H) before the integrity of the shutoff valve 305 has been compromised by the drill out, thereby releasing any gas 310 accumulated in the liner bore in a controlled fashion.

Alternatively, the cement bond 307 may be omitted and the receptacle 306 may extend outward to the housing 304 and downward to a bottom of the shutoff valve 305 and have the bleed passages 309 formed therein. In this alternative, the housing 304 may have a threaded coupling formed in an inner surface thereof and the receptacle 306 may have a threaded coupling formed in an outer surface thereof for connection of the receptacle and the housing.

The alternative LDA 300 may include the expander 53, a liner isolation valve 303, the latch 55, and the stinger 56. The alternative LDA members may be connected to each other, such as by threaded couplings.

Figures 19A, 19B, 19C:
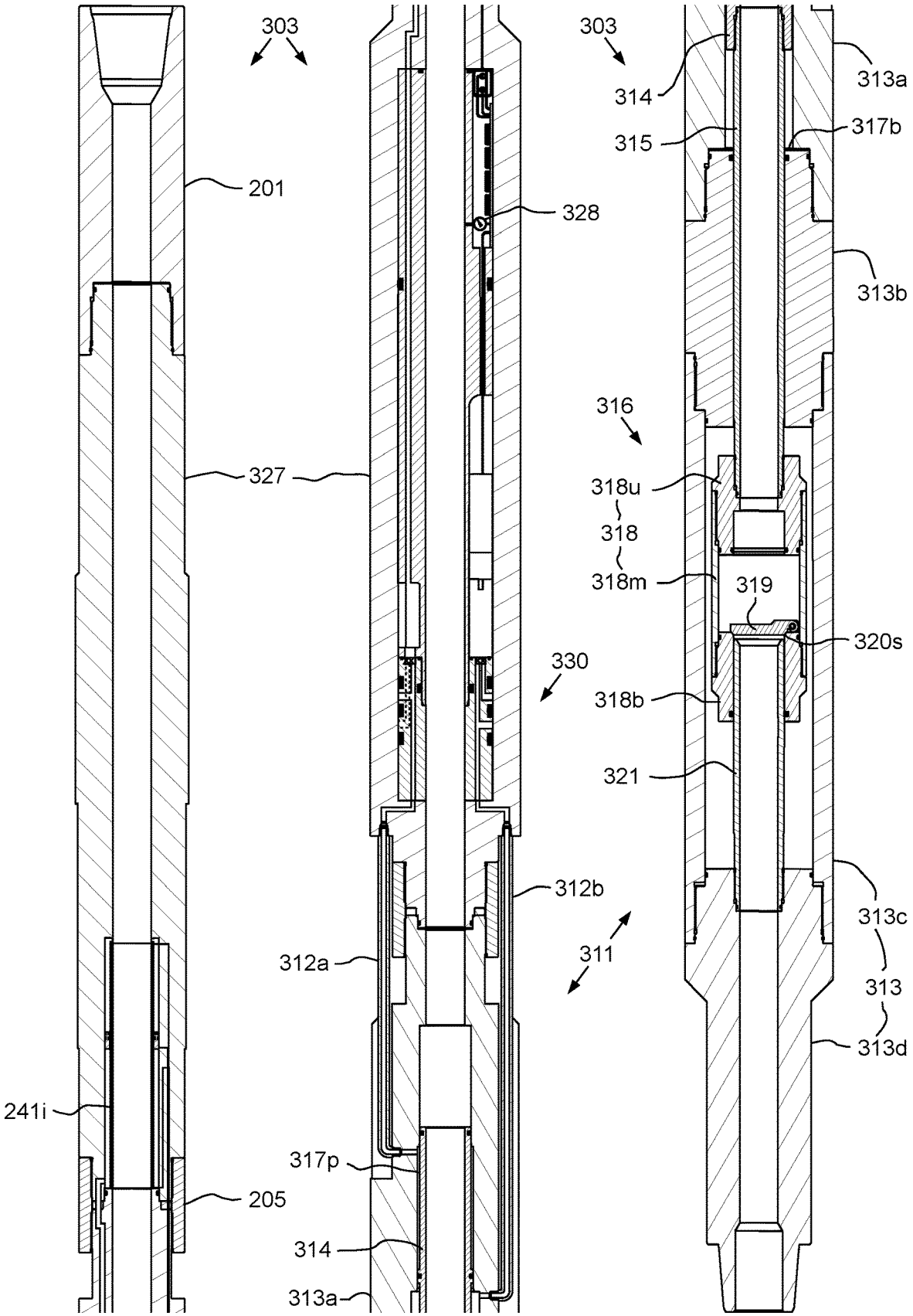
FIGS. 19A-19C illustrate a liner isolation valve of the alternative LDA in a check position.
Figures 19D, 20A, 20B:
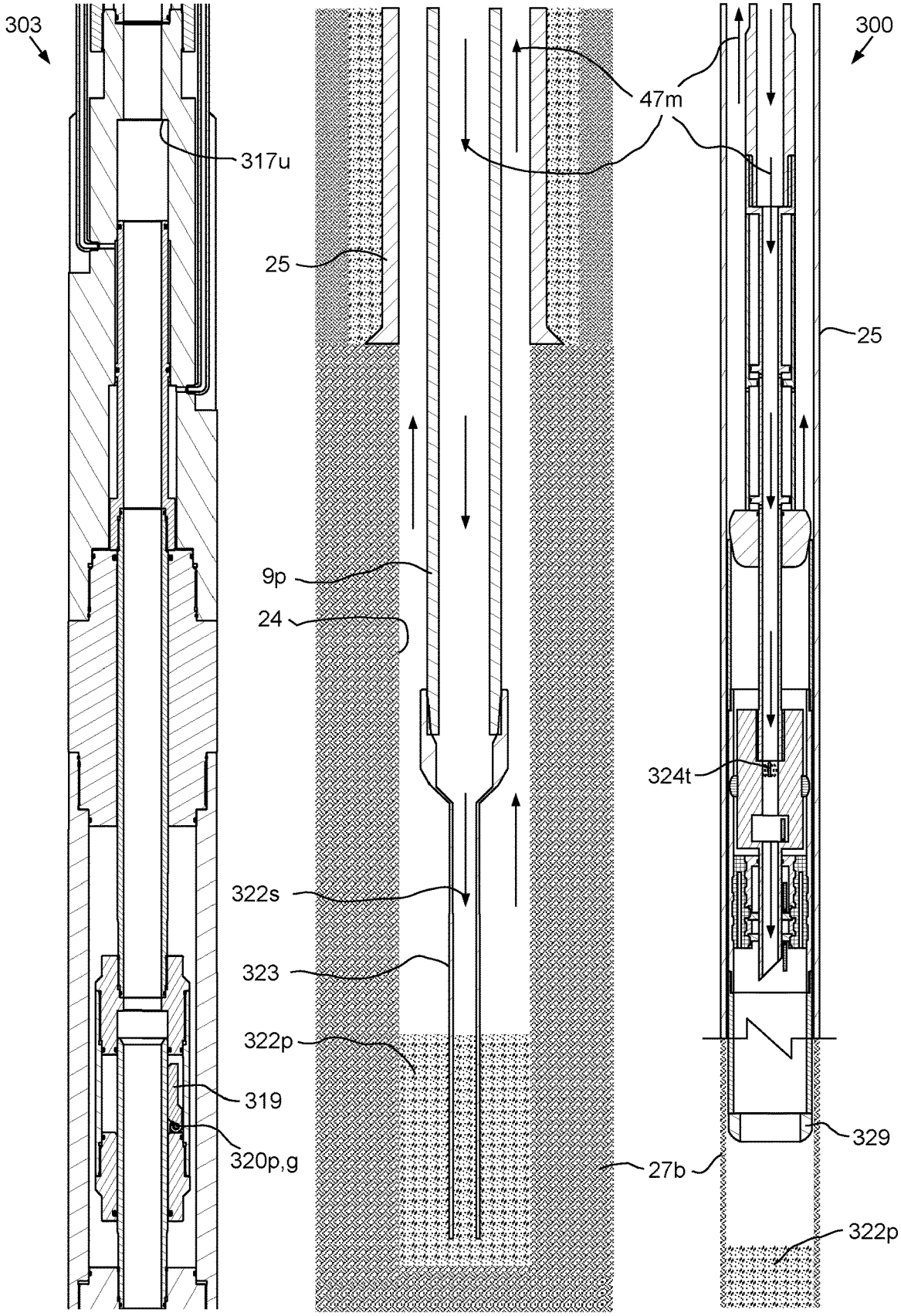
FIG. 19D illustrates the liner isolation valve in an open position.
FIG. 20A illustrates spotting of a cement slurry puddle in preparation for liner string deployment.
FIGS. 20B-20G illustrate operation of the alternative LDA and the float collar.

FIGS. 19A-19C illustrate the liner isolation valve 303 in a check position. FIG. 19D illustrates the liner isolation valve 303 in an open position. The liner isolation valve 303 may include the adapter 201, a control module 327, and a valve module 311. The control module 327 and valve module 311 may be connected to each other longitudinally, such as by the threaded nut 205 and threaded couplings, and torsionally, such as by castellations. The control module 327 may be in fluid communication with the valve module 311, such as by one or more (pair shown) hydraulic conduits 312*a,b*. The control module 327 may be similar to the control module 202 except for omission of the second pair of control valves, associated hydraulic passages, and pressure sensors from a manifold 330 thereof, omission of the outer antennas and associated components therefrom, and addition of a pressure sensor 328 thereto. The pressure sensor 328 may be added to the electronics package and a port may be formed through a mandrel of the control module 327 placing the pressure sensor in fluid communication with a bore of the control module.

The valve module 311 may include a housing 313, a piston 314, a mandrel 315, and a check valve 316. The housing 313 may include two or more tubular sections 313*a-d* connected to each other, such as by threaded couplings. The housing 313 may have a coupling, such as a threaded coupling, formed at a lower longitudinal end thereof for connection to the stinger 56. An upper housing 313*a* section may also have channels formed in an outer surface thereof for passage of the hydraulic conduits 312*a,b*.

The piston 314 and mandrel 315 may each be tubular and have a longitudinal bore formed therethrough. The piston 314 and mandrel 315 may be connected together, such as by threaded couplings. The piston 314 and mandrel 315 may each be disposed in the housing 313 and longitudinally movable relative thereto between an upper position (FIGS. 19B and 19C) and a lower position (FIG. 19D). An actuation chamber may be formed between the piston 314 and the housing 313. A shoulder 317*p* formed in an outer surface of the piston 314 may be disposed in the actuation chamber and carry a seal in engagement with an inner surface of the upper housing section 313*a*. The piston shoulder 317*p* may divide the actuation chamber into a pusher portion and a puller portion. A shoulder 317*u* formed in an inner surface of the upper housing section 313*a* may serve as an upper end of the actuation chamber. An upper end of the second housing section 313*b* may serve as a lower end 317*b* of the actuation chamber. Each portion of the actuation chamber may be in fluid communication with a respective hydraulic conduit 312*a,b* via a respective hydraulic passage formed in a wall of the upper housing section 313*a*.

The check valve 316 may include an outer body 318, a valve member, such as a flapper 319, a seat 320*s*, a flapper pivot 320*p*, a torsion spring 320*g*, and a stem 321. The body 318 may be connected to a lower end of the mandrel 315, such as by threaded couplings, and have two or more sections, such as an upper section 318*u*, a mid section 318*m*, and a lower section 318*b*, each connected together, such as by threaded couplings. The flapper 319 may be pivotally connected to the lower body section 318*b* by the pivot 320*p* and biased toward a closed position by the torsion spring 320*g*. In the check position, the flapper 319 may be downwardly closing to allow upward fluid flow from the stem 321 into the mandrel 315 and prevent downward flow from mandrel to the stem to facilitate operation of the expander 53. In the open position, the flapper 319 may be propped open by the stem 321.

The stem 321 may be connected to an upper end of the lower housing section 313*d*, such as by threaded couplings. Movement of the piston 314 and mandrel 315 from the upper position to the lower position may carry the housing and flapper 319 and cause an upper end of the stem 321 to engage the flapper and force the flapper toward the open position. The upper body section 318*a* may have a receptacle for receiving the upper end of the stem 321 and a seal may be carried in the receptacle for isolating an interface formed between the body 318 and the stem. Movement of the piston 314 and mandrel 315 from the lower position to the upper position may carry the housing and flapper 319 and disengage the upper end of the stem 321 from the flapper 319, thereby allowing the torsion spring 320*s* to close the flapper. The seat 320*s* may be formed in an inner surface of the lower body section 318*b* and receive the flapper 319 in the closed position.

FIG. 20A illustrates spotting of a cement slurry puddle 322*p* in preparation for liner string deployment. Once the wellbore 24 has been extended into the lower formation 27*b*, the drill string may be retrieved to the drilling rig 1*r*, the drill bit replaced by a stinger 323, and the workstring 9*p*, 323 deployed to into the wellbore 24 until the stinger 323 is at bottom hole. A quantity of cement slurry 322*s* may be pumped down the workstring 9*p*, 323 followed by the drilling fluid 47*m*. The cement slurry 322*s* may be discharged from the stinger 323, thereby forming the puddle 322*p*. Pumping of the cement slurry 322*s* may cease when the puddle height equals the level of cement slurry in the stinger 323 (balanced puddle). The workstring 9*p*, 323 may then be retrieved to the drilling rig 1*r*. The cement slurry 322*s* may be blended with sufficient retarders such that the thickening time of the puddle 322*p* is greater than the expected time to deploy and set the alternative liner string 301, such as greater than or equal to one day, three days, or one week.

Additionally, a quantity of spacer fluid (not shown) may be pumped ahead of the cement slurry 322*s*.

FIGS. 20B-20G illustrate operation of the alternative LDA 300 and the float collar 302. Referring specifically to FIG. 20B, once the puddle 322*p* has been spotted and the workstring 9*p*, 323 retrieved, the alternative liner string 301 may be assembled and fastened to the alternative LDA 300. The workstring 9*p*, 300 may be assembled to deploy the alternative liner string 301 into the lower formation 27*b*. For deployment, the liner isolation valve 303 may be in the open position. During deployment before the guide shoe 329 reaches the puddle, drilling fluid 47*m* may be forward circulated by injecting the fluid down a bore of the workstring and the drilling fluid may return to the rig 1*r* via the annulus 48. Once the guide shoe 329 has reached a depth adjacent to a top of the puddle 322*p*, advancement of the alternative liner string 301 may be halted and an RFID tag 324*t* may be launched using one of the launchers 43*b,c* and pumped down the workstring bore to the inner antenna 241*i*. The MCU may receive the command signal from the tag 324*t* and shift the check valve 316 to the check position. Circulation of the drilling fluid 47*m* may be halted once the check valve 316 has shifted.

Figure 20C:
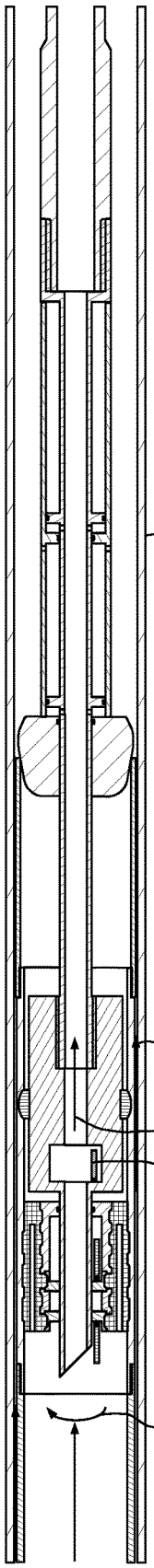

Referring specifically to FIG. 20C, once the check valve 316 has been shifted, advancement of the alternative liner string 301 may resume, thereby displacing the puddle 322*p* into the annulus 48 and the bore of the alternative liner string 301. Displacement of the puddle 322*p* may open the flapper 319, thereby preventing exertion of surge pressure on the lower formation 27*b*. The alternative liner string 301 may be rotated 8 during displacement of the puddle 322*p*. Once the alternative liner string 301 has reached a desired depth, the puddle 322*p* may be displaced to a level adjacent to the liner hanger 15*h*.

Figure 20D:
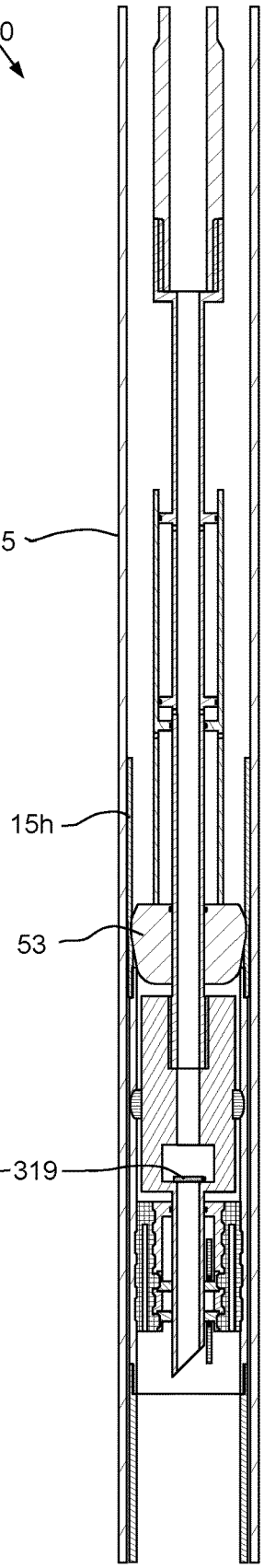
Figure 20E:
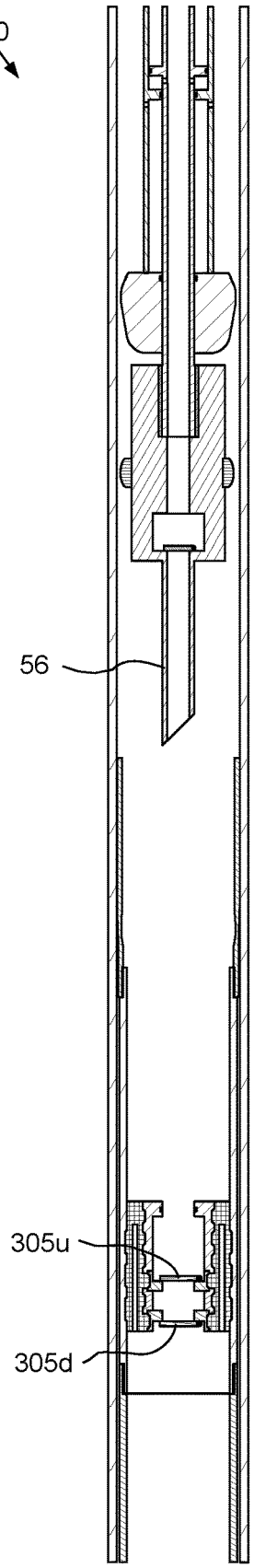

Referring specifically to FIG. 20D, once the alternative liner string 301 has been deployed to the desired depth, rotation 8 may be halted. Once pressure has equalized, the flapper 319 may close. Pressure may then be increased in the workstring bore to operate the expander piston, thereby driving the expander cone through the expandable liner hanger 15*h*. Referring specifically to FIG. 20E, once the hanger 15*h* has been expanded into engagement with the casing 25, the latch 55 may be released from the float collar 302 and the alternative LDA 300 disengaged from the liner string 15 by raising the workstring 9, thereby closing the float collar.

Figure 20F:
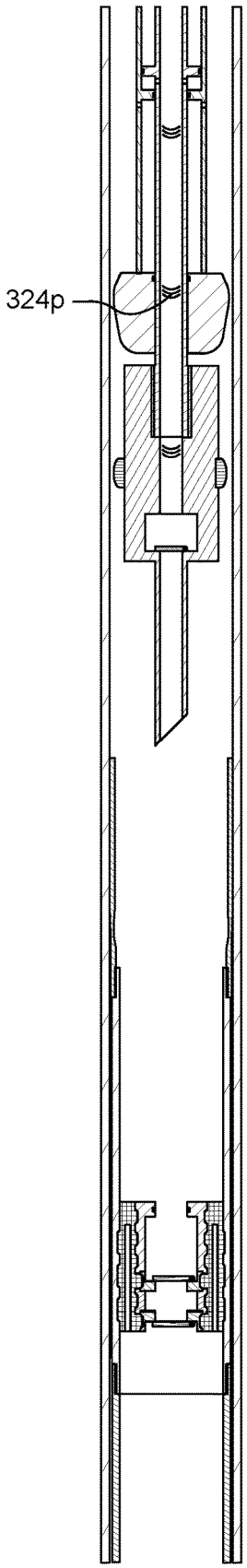
Figure 20G:
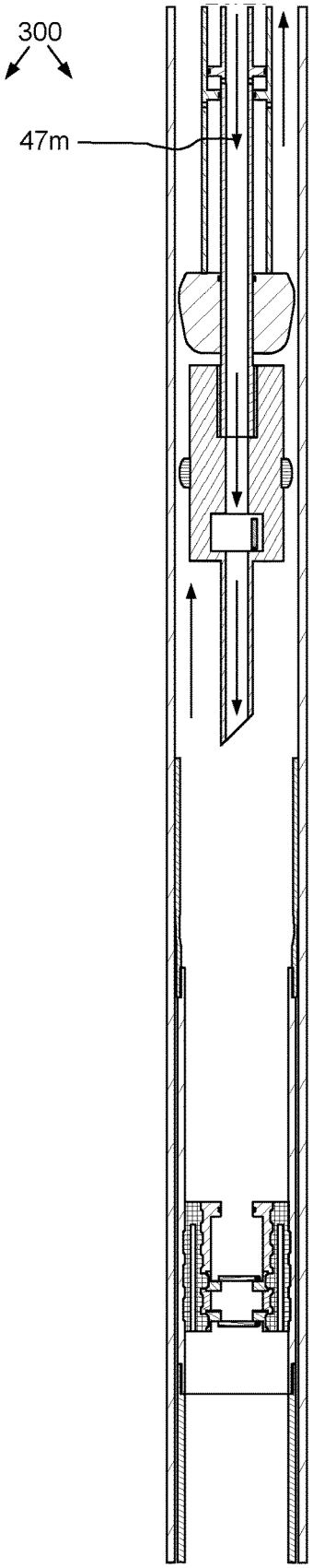

Referring specifically to FIG. 20F, pressure pulses 324*p* may be transmitted down the workstring bore to the pressure sensor 328 by pumping against the closed flapper 319 and then relieving pressure in the workstring bore according to a protocol. The MCU may receive the command signal from the pulses 324*p* and shift the check valve 316 to the open position. Referring specifically to FIG. 20G, once the check valve 316 has been opened, the workstring 9*p*, 300 may then be flushed by forward circulation of the drilling fluid 47*m* as the workstring 9*p*, 300 is being retrieved to the rig 1*r*. A wiper plug (not shown) may also be pumped through the workstring 9*p*, 300 to facilitate flushing.

Figure 20H:
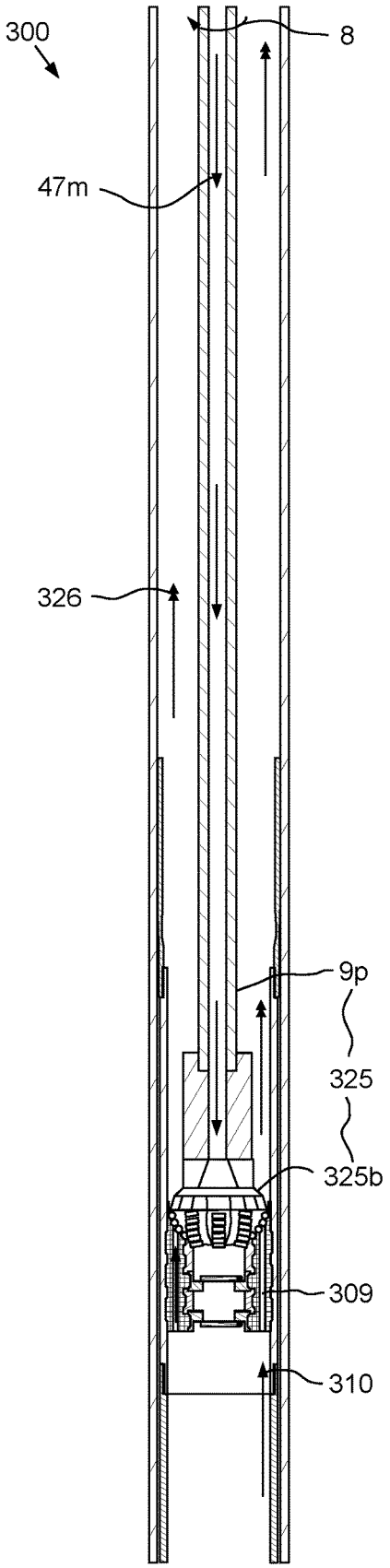
FIG. 20H illustrates further operation of the float collar.

FIG. 20H illustrates further operation of the float collar 302. Once the workstring 9*p*, 300 has been retrieved to the drilling rig 1*r*, the MODU 1*m* may be dispatched from the wellsite and an intervention vessel (not shown) sent to the wellsite. A drill string 325 may be deployed to the float collar 302 from the intervention vessel. Drilling fluid 47*m* may be pumped down the drill pipe 9*p* and a drill bit 325*b* rotated 8 to drill out the float collar 302. During drill out, the bleed passages 309 may be opened, thereby slowly venting the accumulated gas 310. The gas 310 may mix with the cuttings from drill out and the drilling fluid 47*m* discharged from the drill bit 325*b* to form gas cut returns 326. The intervention vessel may have an rotating control device (RCD) assembled as part of an intervention riser thereof. The RCD may have a stripper seal engaged the drill pipe 9*p* to divert the gas cut returns 326 into a mud gas separator for safe handling.

Alternatively, a diverter of the intervention vessel may have an RCD conversion kit installed therein. Alternatively, the drill string may have coiled tubing instead of drill pipe and a downhole motor for rotating the drill bit and the diverter of the intervention vessel may be engaged with the coiled tubing.

Alternatively, the liner isolation valve 303 may be used with any of the other LDAs 9*d*, 200 instead of the liner isolation valve 54 and allow for the omission of the flushing sub 52 therefrom.

Alternatively, the float collar 302 may be used with the liner string 15 instead of the float collar 15*c* for the reverse cementing operation. Alternatively, the float collar 302 may be used adjacent a bottom of a liner string in a forward cementing operation, especially one using a light chaser fluid to place the liner string in compression during curing of the cement slurry.

Figure 21A:
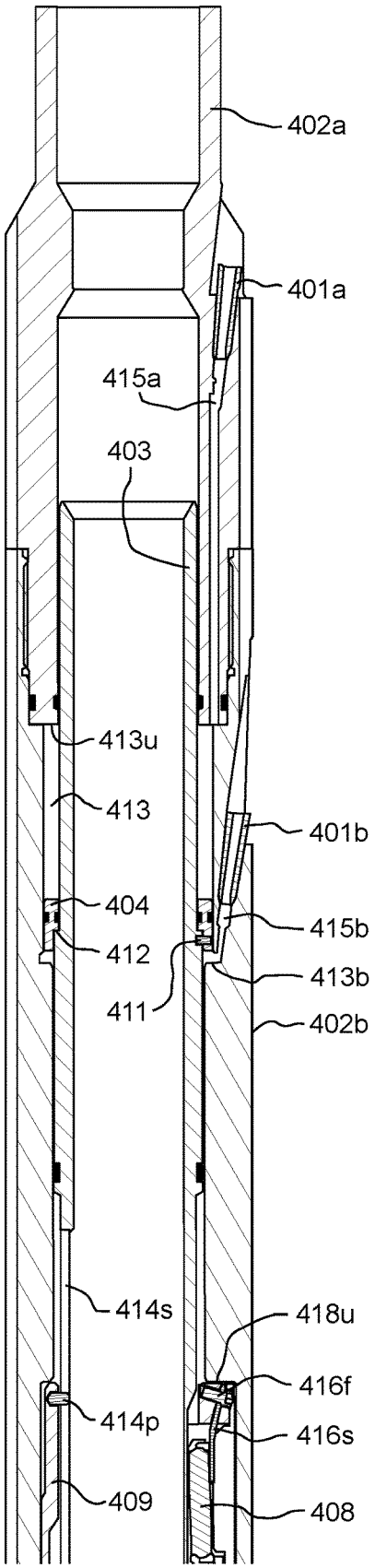
FIGS. 21A and 21B illustrate a valve module of an alternative liner isolation valve, according to another embodiment of this disclosure.
Figure 21B:
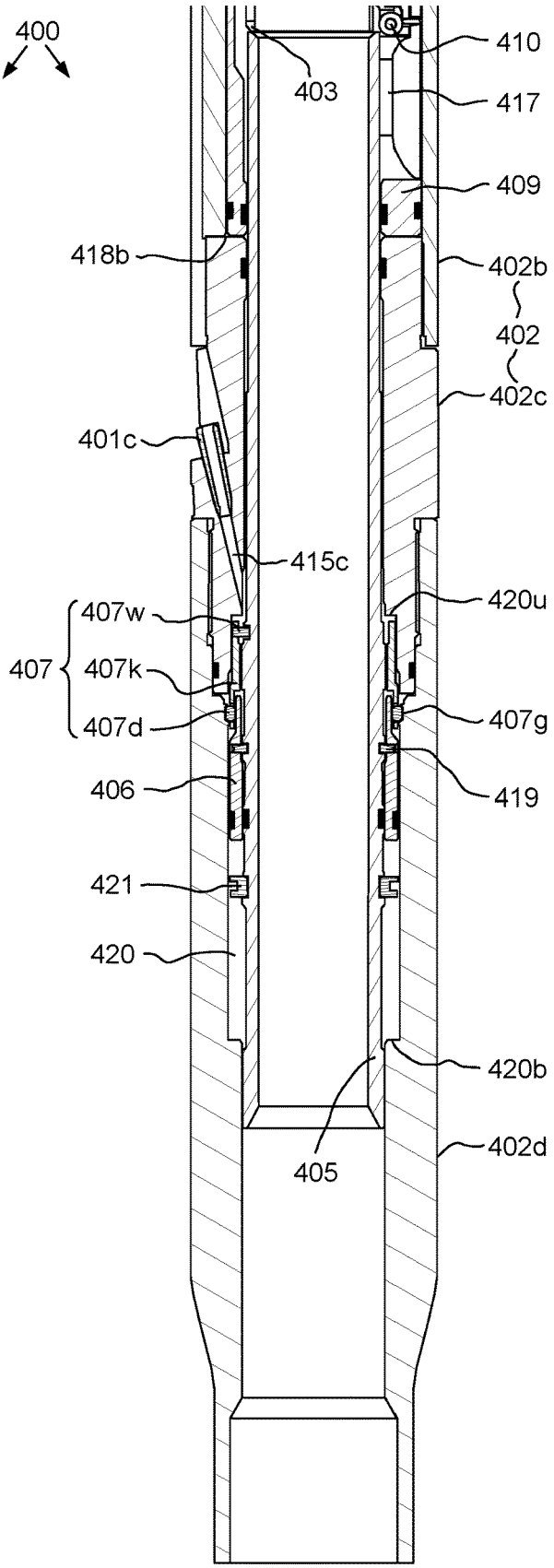

FIGS. 21A and 21B illustrate a valve module 400 of an alternative liner isolation valve, according to another embodiment of this disclosure. The alternative liner isolation valve may include the adapter 201, an alternative control module (not shown), and the valve module 400. The alternative control module may be similar to the control module 327 but with the addition of a third outlet to the manifold for connection of a hydraulic conduit to the reservoir chamber thereof and pressure sensors to the manifold. The alternative control module and valve module 400 may be connected to each other longitudinally, such as by the threaded nut (not shown) and threaded couplings, and torsionally, such as by castellations. The alternative control module may be in fluid communication with the valve module 400, such as by three hydraulic conduits (only respective fittings 401*a-c* shown). The alternative liner isolation valve may be used with any of the other LDAs 9*d*, 200, 300 instead of the respective liner isolation valves 54, 303 and allow for the omission of the flushing sub 52 from the LDAs 9*d*, 200.

The valve module 400 may include a housing 402, a flow tube 403, a flow tube piston 404, a seat 405, a seat piston 406, a seat latch 407, a flapper 408, a body 409, and a hinge 410. The housing 402 may include two or more tubular sections 402*a-d* connected to each other, such as by threaded couplings. The housing 402 may have a coupling, such as a threaded coupling, formed at a lower longitudinal end thereof for connection to the stinger 56. The first, second, and third housing sections 402*a-c* may also have channels formed in an outer surface thereof for passage of the respective hydraulic conduits.

Figure 22A:
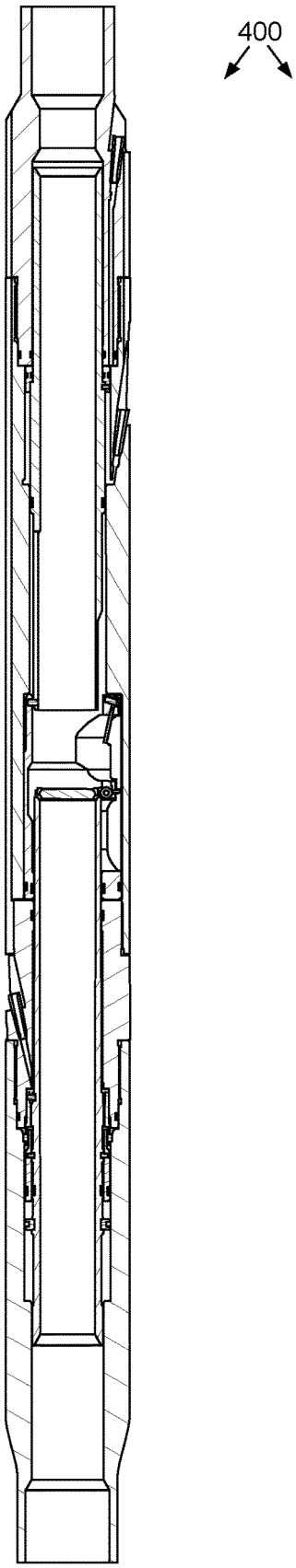
FIGS. 22A-22C illustrate operation of the valve module.
Figure 22B:
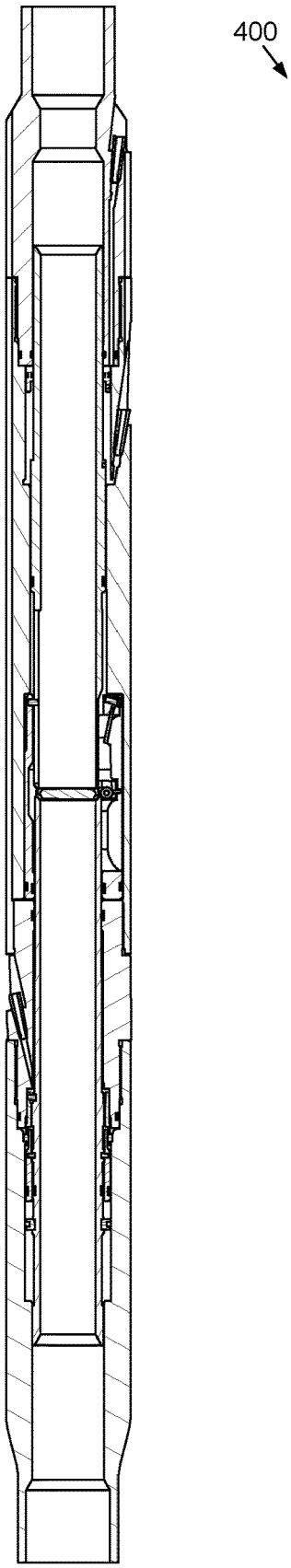
Figure 22C:
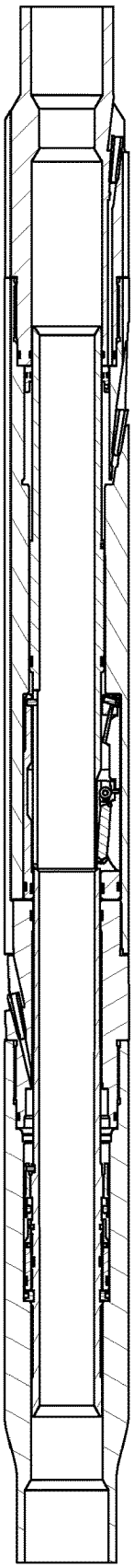

The flow tube 403 may be disposed within the housing 402 and be longitudinally movable relative thereto between an upper position (FIG. 22A) and a lower position (FIG. 22C). The flow tube piston 404 may be releasably connected to the flow tube 403, such as by a shearable fastener 411. The flow tube piston 404 may carry a pair of seals for sealing respective interfaces formed between the flow tube piston and the housing 402 and between the flow tube piston and the flow tube 403. The flow tube 403 may also have a piston shoulder 412 and carry a seal for sealing an interface formed between the flow tube and the housing 402. The flow tube 403 may be torsionally connected to the body 409 by a linkage, such as a pin 414*p* and slot 414*s*, thereby allowing longitudinal movement therebetween.

A hydraulic chamber 413 may be formed longitudinally between a bottom 413*u* of the first housing section 402*a* and a shoulder 413*b* formed in an inner surface of the second housing section 402*b*. The first housing section 402*a* may carry a pair of seals for sealing respective interfaces formed between the first and second 402*b* housing sections and between the first housing section and the flow tube 403. Hydraulic fluid (not shown) may be disposed in the chamber 413. The hydraulic fluid may be refined or synthetic oil. An upper end of the hydraulic chamber 413 may be in fluid communication with a first hydraulic fitting 401*a* via a first hydraulic passage 415*a* formed through a wall of the first housing section 402*a*. The first hydraulic fitting 401*a* may connect the upper end of the first hydraulic chamber 413 to the control module reservoir. A lower end of the hydraulic chamber 413 may be in fluid communication with second hydraulic fitting 401*b* via a second hydraulic passage 415*b* formed through a wall of the second housing section 402*b*.

The flapper 408 may be pivotally connected to the body 409 by the hinge 410. The flapper 408 may pivot about the hinge 410 between an upwardly open position (shown), a closed position (FIGS. 22A and 22B), and a downwardly open position (FIG. 22C). The flapper 408 may be biased away from the upwardly open position by a kickoff spring 416*s* connected to the body 409, such as by a fastener 416*f*. A lower periphery of the flapper 408 may engage a seating profile formed in an upper portion of the seat 405 in the closed position, thereby isolating an upper portion of the valve module bore from a lower portion of the valve module bore. The interface between the flapper 408 and the seat 405 may be a metal to metal seal. The hinge 410 may include a knuckle of the body 409, a knuckle of the flapper 408, a fastener, such as hinge pin, extending through holes of the flapper knuckle and the body knuckle, and a spring, such as a torsion spring. The torsion spring may be wrapped around the hinge pin and have ends in engagement with the flapper 408 and the body 409 so as to bias the flapper toward the downwardly open position.

The body 409 may be trapped in the housing 402 by being disposed between a shoulder 418*u* formed in an inner surface of the second housing section 402*b* and a top 418*b* of the third housing section 402*c*. In either of the open positions, a flapper chamber 417 may be formed radially between a cavity formed in a wall of the body 409 and a portion of each of the flow tube 403 and the seat 405 and the (open) flapper 408 may be stowed in the flapper chamber. The flapper 408 may have a flat disk shape to accommodate stowing in the flapper chamber 417 in both open positions and the seat profile may have a complementary shape.

The seat 405 may be disposed within the housing 402 and be longitudinally movable relative thereto between an upper position (shown and FIGS. 22A and 22B) and a lower position (FIG. 22C). The seat piston 406 may be releasably connected to the seat 405, such as by one or more (pair shown) shearable fasteners 419. The seat piston 406 may carry a seal for sealing an interface formed between the seat piston and the housing 402. The seat 405 may carry a seal for sealing an interface formed between the seat and the seat piston 406. One or more (pair shown) lugs 421 may be fastened to an outer surface of the seat 405.

A second hydraulic chamber 420 may be formed longitudinally between a shoulder 420*u* formed in an inner surface of the third housing section 402*c* and a shoulder 420*b* formed in an inner surface of the fourth housing section 402*d*. The third housing section 402*c* may carry a seal for sealing an interface formed between the third and fourth 402*d* housing sections. The seat piston 406 may divide the second chamber 420 into an upper portion and a lower portion. Hydraulic fluid (not shown) may be disposed in the second chamber upper portion and the second chamber lower portion may be in fluid communication with the valve module bore. An upper end of the second chamber 420 may be in fluid communication with a third hydraulic fitting 401*c* via a third hydraulic passage 415*c* formed through a wall of the third housing section 402*c*.

The latch 407 may releasably connect the seat 405 to the housing 402. The latch 407 may include an upper portion of the seat piston 406, a keeper 407*k*, and one or more (pair shown) fasteners, such as dogs 407*d*. The keeper 407*k* may be connected to the seat 405, such as by threaded couplings and a set screw 407*w*. The keeper 407*k* may have an opening formed through a wall thereof for receiving a respective dog 407*d*. Each dog 407*d* may be radially movable between an extended position (shown and FIGS. 22A and 22B) and a retracted position (FIG. 22C). The fourth housing section 402*d* may have a groove 407*g* for receiving the dogs in the extended position. The dogs 407*d* may be trapped in the groove 407*g* by the upper portion of the seat piston 406, thereby latching the seat 405 to the housing 402.

FIGS. 22A-22C illustrate operation of the valve module 400. During deployment of the liner string (and cementing if used for a reverse cementing operation), the valve module 400 may be in a running position (FIGS. 21A and 21B). In this position, the flow tube 403 may prop the flapper 408 in the upwardly open position against the kickoff spring 416*s*.

Referring specifically to FIG. 22A, once it is time to set the liner hanger for a reverse cementing operation or once it is time to advance the liner string into the cement puddle, an RFID tag (not shown) may be launched using one of the launchers 43*b,c* and pumped down the workstring bore to the inner antenna 241*i*. The MCU may receive the command signal from the tag and shift the valve module 400 to the closed position by pressurizing a lower portion of the hydraulic chamber 413 via the second fitting 401*b* and the second hydraulic passage 415*b*, thereby pushing the flow tube piston 404 and flow tube 403 upward until a lower portion of the flow tube disengages from the flapper 408, thereby allowing the kickoff spring 416*s* to push the flapper outward from the flapper chamber 417 into the valve module bore and the torsion spring to pivot the flapper into engagement with the seat 405. Upward movement of the flow tube may cease upon engagement of the flow tube piston 404 with the bottom 413*u* of the first housing section 402*a*. If the valve module 400 is being used for a puddle cementing operation, the valve module may be left in this position to function as a check valve.

Referring specifically to FIG. 22B, if the valve module 400 is being used for a reverse cementing operation, once the flow tube 403 has reached the upper position, the MCU may continue to pressurize the lower portion of the hydraulic chamber 413. The pressure in the chamber lower portion may exert an upward force against the flow tube piston 404 and a downward force on the flow tube piston shoulder 412, thereby exerting a shear force on the shearable fastener 411. Pressurization may continue until the shearable fastener 411 fractures, thereby pushing the flow tube piston shoulder 412 downward until a bottom of the flow tube 403 engages an upper periphery of the flapper 408 and keeps the flapper against the seat 405. The MCU may also hydraulically lock the flow tube 403 against the closed flapper 408 to impart bidirectional capability to the valve module 400.

Referring specifically to FIG. 22C, once the liner hanger has been set, pressure pulses (not shown) may be transmitted down the workstring bore to the electronics package pressure sensor by pumping against the closed flapper 408 and then relieving pressure in the workstring bore according to a protocol. If the valve module 400 is being used for a puddle cementing operation, the MCU may shift the valve module to the closed position of FIG. 22B before shifting to the downwardly open position. The MCU may receive the command signal from the pulses and pressurize the second hydraulic chamber upper portion via the third fitting 401*c* and the third hydraulic passage 415*c*, thereby exerting a downward force on the seat piston 406 until the pressure increases sufficiently to fracture the shearable fastener 419. Once the seat piston 406 has been released from the seat 405, the seat piston may then travel downwardly until a bottom thereof engages the lugs 421, thereby freeing the dogs 407*d*. The seat piston 406 may push the seat 405 downward until the lugs 421 engage the shoulder 420*b*. The torsion spring may then pivot the flapper 408 into the flapper chamber 417, thereby to the downwardly opening the flapper.

The MCU may then re-pressurize the lower portion of the hydraulic chamber 413 via the second fitting 401*b* and the second hydraulic passage 415*b*, thereby pushing the flow tube piston shoulder 412 downward until the flow tube bottom engages a top of the seat 405, thereby covering the flapper in the downwardly open position for protection thereof. The workstring may then be flushed.

Alternatively, any of the other electronics packages may have one or more pressure sensors in fluid communication with the workstring bore and/or the annulus instead of or in addition to the antennas such that the LDA tools may be operated using mud pulses (static pressure pulse or dynamic choke pulse) instead of or as a backup to the RFID tags. Alternatively, any of the electronics packages may have one or more tachometers such that the LDA tools may be operated using rotational speed telemetry instead of or as a backup to the RFID tags or pressure pulses. Alternatively, time delay, radioactive tags, chemical tags (e.g., acidic or basic), distinct fluid tags (e.g., alcohol), wired drill pipe, or optical fiber drill pipe may be used instead of or as a backup to the RFID tags or pressure pulses.

While the foregoing is directed to embodiments of the present disclosure, other and further embodiments of the disclosure may be devised without departing from the basic scope thereof, and the scope of the invention is determined by the claims that follow.

The invention claimed is:

1. A method of hanging a liner string from a tubular string cemented in a wellbore, comprising:

running the liner string into the wellbore using a workstring having a liner deployment assembly (LDA) while pumping drilling fluid down an annulus formed between the workstring, liner string, and the wellbore and receiving returns up a bore of the workstring and liner string, wherein:

the LDA comprises a crossover tool, a liner isolation valve (LIV), and a setting tool, the crossover tool comprises a seal engaged with the tubular string and bypass ports straddling the seal, the crossover tool is in a first position, and the liner isolation valve is open; and shifting the crossover tool to a second position by pumping a first tag down the annulus to the LDA.

2. The method of claim 1, wherein the liner isolation valve (LIV), includes:

a valve module, comprising:

a tubular housing for assembly as part of a workstring;

a flapper disposed in the housing and pivotable relative thereto between an upwardly open position, a closed position, and a downwardly open position;

a flow tube longitudinally movable relative to the housing for propping the flapper in the upwardly open position and covering the flapper in the downwardly open position; and a seat longitudinally movable relative to the housing for engaging the flapper in the closed position; and a valve control module comprising an electronics package and an actuator in communication with the electronics package and operable to actuate the valve module between the positions.

3. The method of claim 1, wherein:

the LDA further comprises a circulation sub in a first position while running the liner string, the bypass ports of the crossover tool are closed in the second position, the circulation sub is also shifted to the second position by pumping the first tag, a bore of the circulation sub is closed in the second position, and a circulation port of the circulation sub is open in the second position.

4. The method of claim 3, further comprising:

before shifting the crossover tool and the circulation sub, pumping a heating fluid adjacent to a formation exposed to the annulus; and after shifting the crossover tool and the circulation sub and while waiting on the heating fluid, pumping the drilling fluid down the workstring bore and receiving the drilling fluid up the annulus using the open circulation port.

5. The method of claim 4, further comprising, after the formation has been heated, pumping a fluid train down a bore of the workstring to the LDA, wherein:

the crossover tool shifts to a third position and the circulation sub shifts to the first position in response to the LDA receiving a second tag of the fluid train, and cement slurry of the fluid train is diverted from the workstring bore and down the annulus to the formation.

6. The method of claim 5, wherein, after diversion of the cement slurry:

the crossover tool shifts to the second position in response to the LDA receiving a third tag of the fluid train, and the liner isolation valve shifts to a check or closed position in response to the LDA receiving a fourth tag of the fluid train.

7. The method of claim 6, further comprising:

pumping down the workstring bore to increase fluid pressure in the workstring bore against the closed liner isolation valve, thereby operating the setting tool to set a hanger of the liner string into engagement with the tubular string; and further increasing pressure in the workstring bore to release the liner string from the LDA.

8. The method of claim 7, further comprising raising the LDA from the liner string, thereby removing a stinger of the LDA from a float collar of the liner string and allowing the float collar to close.

9. The method of claim 8, further comprising:

opening the liner isolation valve by transmitting one or more pressure pulses to the LDA; and flushing the workstring.

10. The method of claim 9, further comprising drilling out the float collar, wherein:

the float collar has opposed check valves and a bleed passage, and the bleed passage is opened before the check valves are drilled out.

11. The method of claim 10, wherein the first tag is electronic.

12. The method of claim 11, wherein the first tag is a radio frequency identification (RFID) tag.

13. A method of performing a wellbore operation, comprising:

assembling an isolation valve as part of a tubular string;

deploying the tubular string into the wellbore, wherein a flow tube of the isolation valve props a flapper of the isolation valve in an open position;

pressurizing a chamber formed between the flow tube and a housing of the isolation valve, thereby operating a piston of the isolation valve to move the flow tube longitudinally away from the flapper, releasing the flapper, and allowing the flapper to close; and further pressurizing the chamber, thereby separating the piston from the flow tube and moving the flow tube longitudinally toward and into engagement with the closed flapper.

14. A method of hanging a liner string from a tubular string cemented in a wellbore, comprising:

spotting a puddle of cement slurry in a formation exposed to the wellbore;

after spotting the puddle, running the liner string into the wellbore using a workstring having a liner deployment assembly (LDA) while pumping drilling fluid down a bore of the workstring and liner string and receiving returns up an annulus formed between the workstring, liner string, and the wellbore, wherein the LDA comprises a liner isolation valve (LIV) in an open position, and a setting tool;

once a shoe of the liner string reaches a top of the puddle, shifting the LIV to a check position by pumping a first tag down the workstring bore; and once the LIV has shifted, advancing the liner string into the puddle, thereby displacing the cement slurry into the liner annulus and liner bore.

15. The method of claim 14, further comprising:

pumping down the workstring bore to close the LIV and increase fluid pressure in the workstring bore against the closed LIV, thereby operating the setting tool to set a liner hanger of the liner string into engagement with the tubular string; and further increasing pressure in the workstring bore to release the liner string from the LDA.

16. The method of claim 15, further comprising raising the LDA from the liner string, thereby removing a stinger of the LDA from a float collar of the liner string and allowing the float collar to close.

17. The method of claim 16, further comprising:

opening the liner isolation valve by transmitting one or more pressure pulses to the LDA; and flushing the workstring.

18. The method of claim 17, further comprising drilling out the float collar, wherein:

the float collar has opposed check valves and a bleed passage, and the bleed passage is opened before the check valves are drilled out.

19. The method of claim 18, wherein the first tag is electronic.

20. The method of claim 19, wherein the first tag is a radio frequency identification (RFID) tag.

* * * * *